US005497220A

United States Patent [19]

Inomata et al.

[11] Patent Number: 5,497,220

[45] Date of Patent: Mar. 5, 1996

[54] DEVELOPING CARTRIDGE HAVING SUPPORT MEMBER FOR ROTATABLY SUPPORTING DEVELOPING DEVICE, AND DEVELOPING APPARATUS

[75] Inventors: Mitsugu Inomata, Kawasaki; Hisayoshi Kojima, Yokohama, both of Japan

[73] Assignee: Canon Kabushiki Kaisha, Tokyo, Japan

[21] Appl. No.: 200,690

[22] Filed: Feb. 23, 1994

[30] Foreign Application Priority Data

Feb. 24, 1993 [JP] Japan ..... 5-059746
Feb. 24, 1993 [JP] Japan ..... 5-059751

[51] Int. Cl.[6] ..... G03G 15/08

[52] U.S. Cl. ..... 355/245; 355/260; 355/327

[58] Field of Search ..... 355/245, 260, 355/259, 326 R, 327; 118/656

[56] References Cited

U.S. PATENT DOCUMENTS 3,987,756 10/1976 Katayama et al. ..... 355/245
4,713,673 12/1987 Kessoku ..... 355/245
4,772,913 9/1988 Watanabe ..... 355/326 X
4,922,301 5/1990 Katoh et al. ..... 355/251
5,249,026 9/1993 Kojima ..... 355/327
5,258,819 11/1993 Kimura et al. ..... 355/326 R
5,276,479 1/1994 Inomata ..... 355/200

FOREIGN PATENT DOCUMENTS

2597993A1 10/1987 France .

*Primary Examiner*—Nestor R. Ramirez
*Attorney, Agent, or Firm*—Fitzpatrick, Cella, Harper & Scinto

[57] ABSTRACT

A developing cartridge includes a developing device having a containing portion containing developer and a bearing member for bearing the developing device, a support member adapted to rotatably support the developing device and having an opening portion, and a lock for locking a rotation of the developing device with respect to the support member at a position there the bearing member is not aligned with the opening portion.

9 Claims, 23 Drawing Sheets

DEVELOPING CARTRIDGE HAVING SUPPORT MEMBER FOR ROTATABLY SUPPORTING DEVELOPING DEVICE, AND DEVELOPING APPARATUS

BACKGROUND OF THE INVENTION

1. Field of the Invention

The present invention relates to a developing apparatus and a developing cartridge used with an image forming apparatus such as a copying machine, a printer and the like and particularly used with a color image forming apparatus.

2. Related Background Art

In full-color image forming apparatuses, a developing unit including a yellow developing device, a magenta developing device, a cyan developing device and a black developing device is rotated so that a selected developing device faces an image bearing member.

When such a developing unit is rotated, since it is possible that developer may leak from the unit or that the developer is scattered, it is desirable to prevent postures or attitudes of the developing devices from changing.

Further, at a connection portion between each developing device and its developer replenishing portion, since the separation and connection are effected in order to switch the developing devices for developing a latent image formed on the image bearing member, the developer was particularly apt to leak. Further, in order to exchange a developing device a service life of which has expired, such a developing device must be exchanged by a new one by an expert and the maintenance must also be performed by the expert. To avoid this, it is considered that each of the developing devices is made as a cartridge.

However, when the postures of the developing devices are maintained in a steady condition, since the developing devices are rotated with respect to the developing unit, it is necessary to provide peripheral gaps between the developing devices and the developing unit. In this case, it is difficult to mount the developing cartridges on the developing unit with the peripheral gaps.

SUMMARY OF THE INVENTION

An object of the present invention is to provide a developing apparatus in which a plurality of developing devices are made as respective cartridges.

Another object of the present invention is to provide a developing apparatus in which developing devices can be shifted while maintaining postures thereof in a steady condition.

A further object of the present invention is to provide a developing cartridge which can be easily mounted.

A still further object of the present invention is to provide a developing cartridge comprising a containing portion for containing developer, a developing device having a bearing member for bearing or carrying the developer, a support member adapted to rotatably support the developing device and having an opening portion, and lock means for locking the rotation of the developing device with respect to the support member at a position where the bearing member is out of the opening portion.

A further object of the present invention is to provide a developing apparatus comprising a developing cartridge including a rotatable developing unit, a containing portion for containing developer, a developing device having a bearing member for bearing or carrying the developer, and a support member having an opening portion and adapted to rotatably support the developing device and supported non-rotatably with respect to the developing unit; and a rotation means for rotating the developing device with respect to the support member when the developing unit is rotated.

The other object of the present invention will be apparent from the following detailed explanation.

DETAILED DESCRIPTION OF THE PREFERRED EMBODIMENTS

Figure 1:
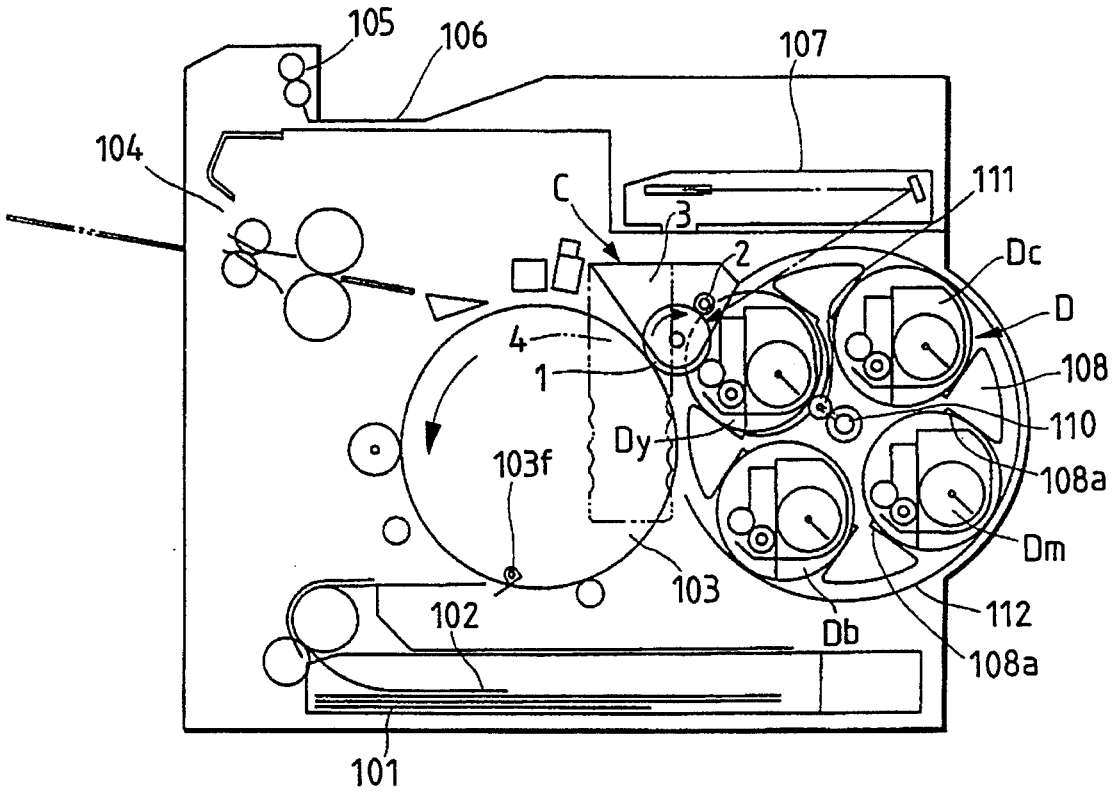
FIG. 1 is a sectional view showing the entire construction of an image forming apparatus having a developing cartridge according to the present invention.

FIG. 1 is a sectional view of an image forming apparatus having a developing apparatus according to a first embodiment of the present invention. The image forming apparatus comprises a drum cartridge C removably mountable to the image forming apparatus and including an image bearing member 1, a charge member 2 and a cleaner 3; a plurality of developing cartirdges D (yellow developing cartridge Dy, magenta developing cartridge Dm, cyan developing cartridge Dc and black developing cartridge Db) each including a developing portion having a developer bearing member and a toner containing portion containing toner (one-component developer) and each removably mountable to the image forming apparatus independently; a developing unit to which the developing cartridges D are removably mounted; and a developing cartridge switching mechanism for rotating the developing unit to bring a selected developing device to a developing position opposed to the image bearing member 1.

According to this image forming apparatus, a latent image for each color is formed on the image bearing member 1 of the drum cartridge C by image exposure by means of an optical unit 107, and the developing cartridge D corresponding to this color is brought, by the switching mechanism, to the latent image, thereby developing the latent image. Images having various colors obtained by such developing operations are successively transferred onto a sheet 102 held by a transfer drum 103 in a superposed fashion. The sheet 102 is supplied from a sheet supply portion 101, and a tip end of the sheet is gripped by a gripper 103f of the transfer drum 103, so that the sheet is mounted around the transfer drum as the transfer drum is rotated. The sheet 102 to which the toner images were transferred is separated from the transfer drum 103 and then is sent to a fixing unit 104, where the toner images are mixed and fixed to the sheet. Thereafter, the sheet is discharged onto a discharge tray 106 through a sheet discharge portion 105.

Figure 2:
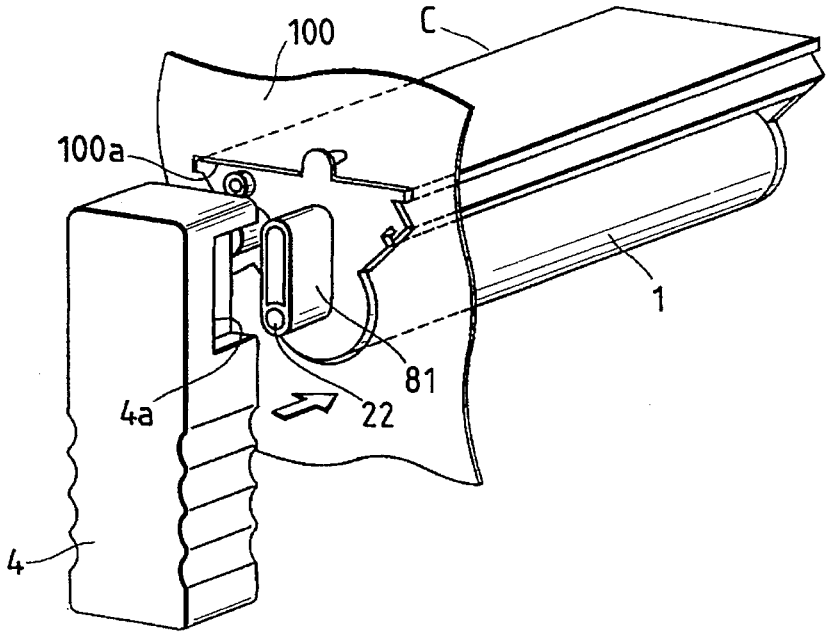
FIG. 2 is a perspective view showing a method for mounting a drum cartridge and a waste toner container provided in the image forming apparatus of FIG. 1.

Next, the drum cartridge C will be explained with reference to FIGS. 2 to 6. As shown in FIG. 2, the drum cartridge C is mounted between a pair of side plates 100 (a front side plate alone is shown) in the image forming apparatus by inserting the drum cartridge into mounting openings 100*a* of the side plates from outside of one of the side plates 100 in a thrust direction (perpendicular to the surface of the side plate 100). In this way, the drum cartridge C is removably mountable to the image forming apparatus in the thrust direction.

A waste toner container 4 is attached to one end of the drum cartridge D protruded from the side plate 100, and a notched portion 4*a* to be fitted onto a cover 81 for covering an exposed central shaft 22 of the image bearing member 1 is formed in an upper portion of the waste toner container 4. The notched portion 4*a* and the cover 81 serve as guides when the waste toner container 4 is mounted to the drum cartridge C.

An opening (not shown) for permitting the mounting and dismounting of the drum cartridge C and the waste toner container 4 with respect to the image forming apparatus is formed in a front outer plate (not shown) of the image forming apparatus.

Figure 3:
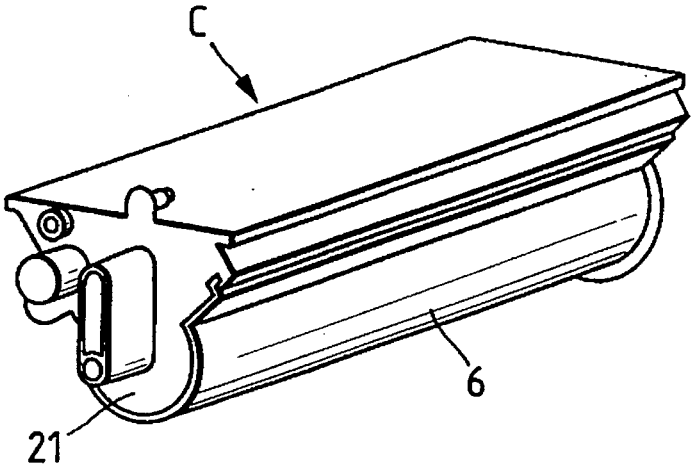
FIG. 3 is a perspective view of the drum cartridge.
Figure 5:
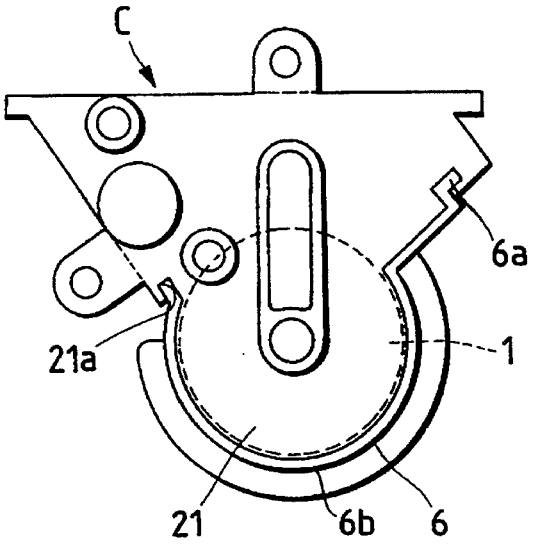
FIG. 5 is an end view of the drum cartridge.

As shown in FIGS. 3 and 5, the drum cartridge C is provided at its both ends with plate-shaped frame portions 21, and the cylindrical image bearing member 1 is rotatably supported between lower portions of the frame portions 21.

Figure 4:
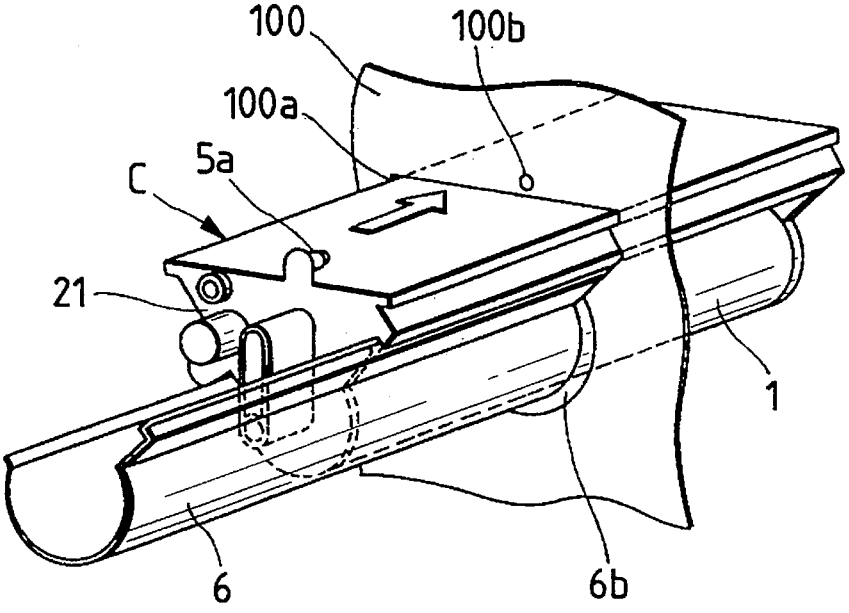
FIG. 4 is a perspective view showing a condition that a protection member is removed when the drum cartridge is mounted.

Before the drum cartridge C is mounted to the image forming apparatus, a semi-circular lower portion of the drum cartridge is covered by a protection member 6 for protection. The protection member 6 has a semicylindrical shape having an open top. The protection member is attached to the drum cartridge C along a longitudinal direction by inserting protruded portions 6*a* formed on both upper ends of the opening of the semi-circular cylinder of the protection member into corresponding notch recesses 21*a* formed in the frame portions 21 of the drum cartridge C. When the drum cartridge C is mounted on the side plates 100, as the drum cartridge C is inserted into the mounting opening 100*a*, as shown in FIG. 4, a frame portion 6*a* formed on a front (regarding an insertion direction of the cartridge) end of the protection member 6 is abutted against the side plate 100, thereby removing the protection member 6 from the drum cartridge C.

Figure 6:
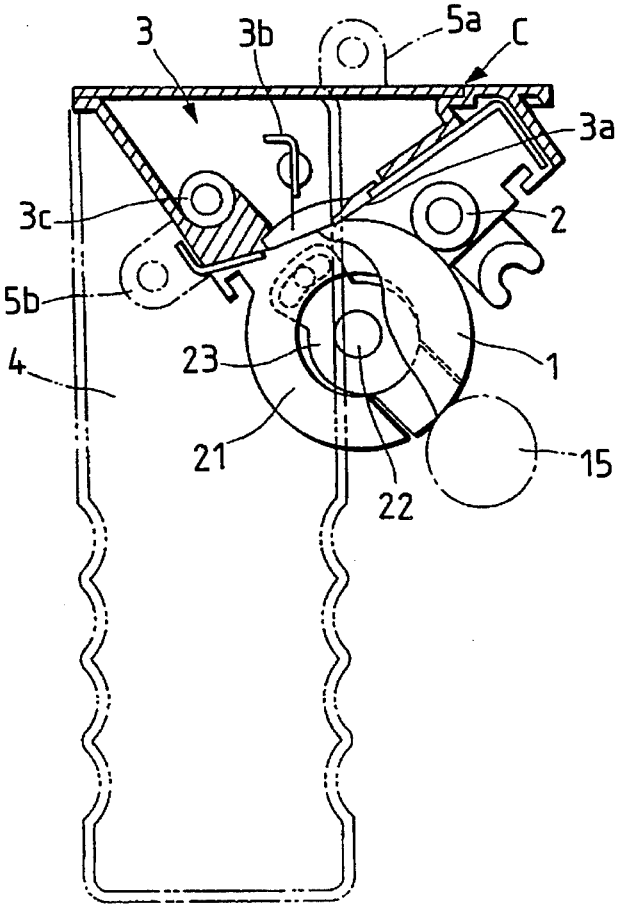
FIG. 6 is a sectional view showing a condition that an eccentric member is provided on a central shaft of an image bearing member arranged in the drum cartridge.

As shown in FIG. 6 (where the front frame portion 21 is omitted from illustration), the drum cartridge C includes the image bearing member 1, a charge member 2 for charging the image bearing member, and a cleaner 3 for removing toner from the image bearing member (cleaning member 3*a*, agitating member 3*b* for agitating the removed toner, and toner feed screw 3*c* for sending the toner to the waste toner container 4). Further, positioning members 5*a*, 5*b* for positioning the drum cartridge C to the side plate 100 are provided on the (front) frame portion 21 near the waste toner container 4.

As shown in FIG. 1, the developing cartridge switching mechanism comprises a pair of plate-shaped developing cartridge holding members 108 rotatable around a non-rotatable central shaft 110 parallel to the shaft of the image bearing member 1, an arcuate guide member 112 secured to the image forming apparatus and surrounding the holding members except for areas where the drum cartridge C and the transfer drum 103 are positioned, a pressure member 111 for urging the selected developing cartridge D toward the image bearing member 1 of the drum cartridge C at the developing position, a drive source for rotating the pressure member 111 for effecting such urging, a positioning member for positioning the developing cartridge D at a predetermined position with respect to the image bearing member 1, and a control mechanism for maintaining each developing cartridge D in a predetermined posture.

Figure 7:
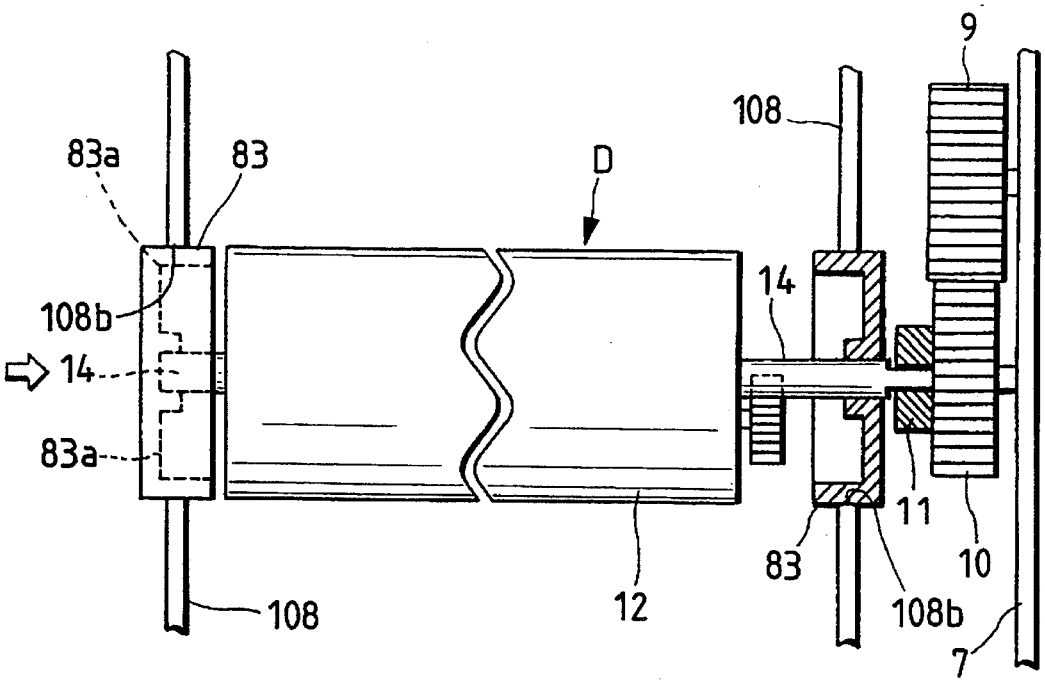
FIG. 7 is a side view, partially in section, showing a method for mounting a switching mechanism for switching a developing cartridge arranged in the image forming apparatus of FIG. 1 onto a holding member.

Each holding member 108 has a shape of a four-leaf clover being provided along its periphery with containing recesses (each comprising a substantially semi-circular notched portion) 108*b* for receiving the corresponding developing cartridges D. As shown in FIG. 7, each developing cartridge D is mounted between the holding members 108 by inserting the cartridge into the pair of containing recesses 108*b* of the holding members 108 while being guided by the guide member 112 at a position other than the developing position opposed to the image bearing member 1. Further, each developing cartridge D can be removed from the holding members 108. In this way, the developing cartridges D of different colors are removably and independently mounted on the switching mechanism and accordingly the image forming apparatus in the thrust direction. Further, openings (not shown) for permitting the mounting and dismounting of the developing cartridges D with respect to the image forming apparatus are formed in the front outer plate (not shown) of the image forming apparatus.

Figure 8:
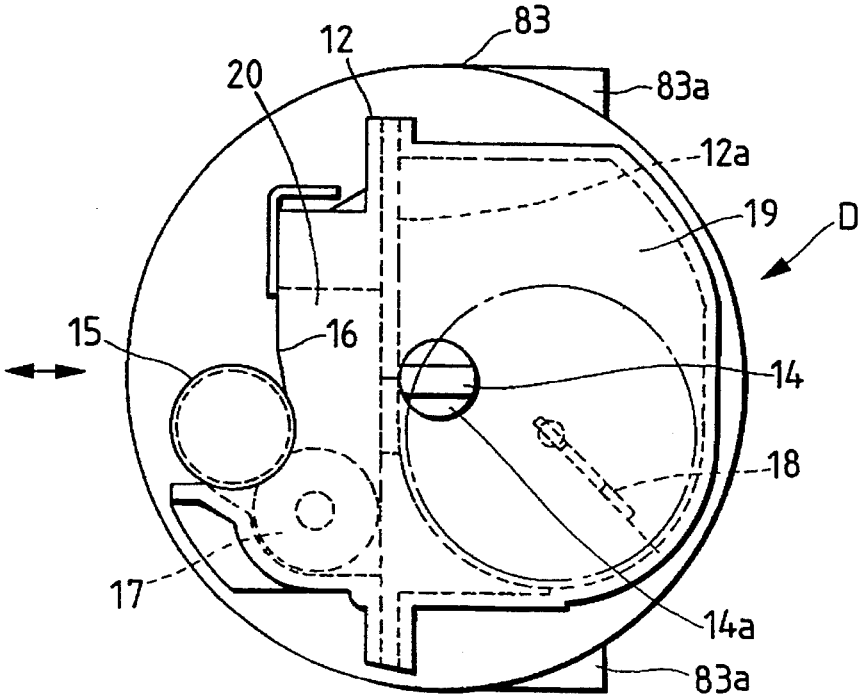
FIG. 8 is a sectional view of the developing cartridge of FIG. 7.

As shown in FIG. 8, the developing cartridge D comprises a developing device 12, and a pair of dishshaped support plates 83 for rotatably supporting the developing device 12 via rotary support shafts 14 secured to both ends of the device 12. The rear (that side) rotary support shaft 14 extends through one of the support plates 83 and is attached to a control mechanism of a developing cartridge switching mechanism which will be described later.

The developing device 12 is generally divided into a toner containing portion 19 and an adjacent developing portion 20. An agitating convey member 18 for agitating the toner and for conveying the toner to the developing portion 20 is arranged in the toner containing portion 19. On the other hand, a developer bearing member 15, a supply and scrape member 17 for supplying the toner to the developer bearing member and for scraping the non-developed toner from the developer bearing member, and a regulating member 16 for regulating a thickness of a toner layer carried on the developer bearing member 15 and for applying the electric charge to the toner are arranged in the developing portion 20.

Leg portions 83*a* corresponding to steps 108*a* formed in the containing recesses 108*b* of the holding member 108 shown in FIG. 1 are provided on both sides of both ends of each support plate 83, so that the support plates 83 of the developing cartridge D contained in the containing recesses 108*b* are non-rotatably held with respect to the holding members 108 by abutting the leg portions 83*a* against the steps 108*a*. When the developing cartridge D is positioned at the developing position, the leg portions 83*a* serve as guides for shifting the developing cartridge D toward the image bearing member 1.

Each developing cartridge D is inserted into and mounted within the containing recesses 108*b* in the holding members 108 in such a manner that the developing device 12 keeps a predetermined posture, i.e., in the illustrated embodiment, the toner containing portion 19 and the developing portion 20 are disposed side by side in a horizontal direction (i.e., a partition wall 12*a* between the toner containing portion 19 and the developing portion 20 is oriented vertically) and thus a parallel portion 14*a* of the rotary support shaft 14 is disposed horizontally.

Figure 9:
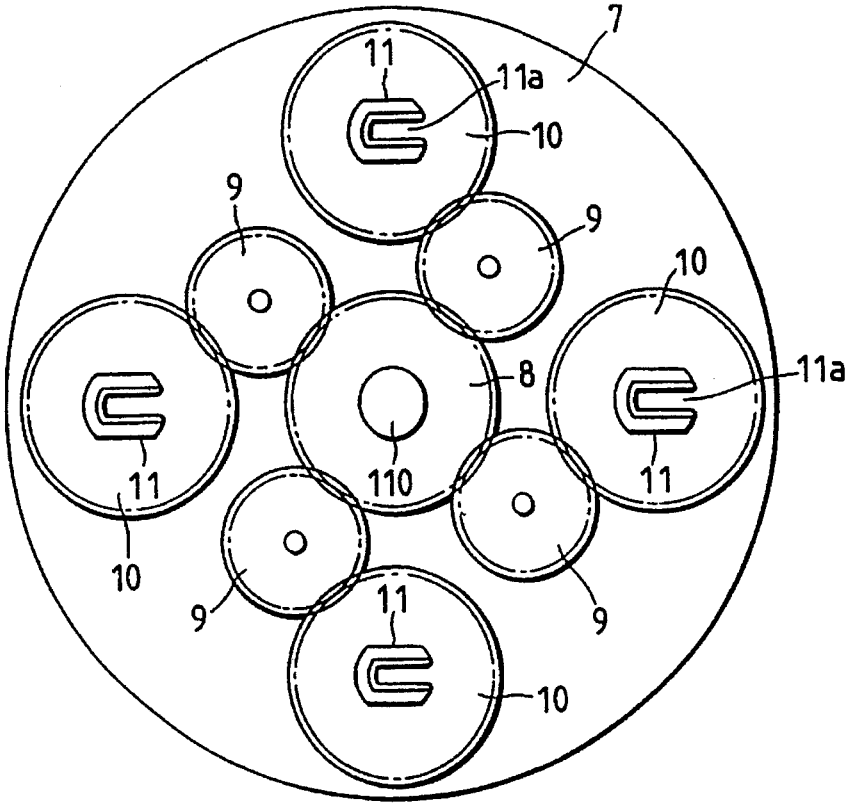
FIG. 9 is a front view showing a developing device drive mechanism and a side plate of the developing cartridge switching mechanism.

As shown in FIG. 1, the developing cartridge switching mechanism is provided with a control mechanism for maintaining the developing device 12 of each developing cartridge D shifted to the developing position by the rotation of the holding members 108 in a predetermined unchanged posture. As shown in FIGS. 7 and 9, the control mechanism has a plate-shaped developing device drive mechanism supporting side plate 7 rotated integrally with the holding member 108 around the non-rotatable central shaft 110 of the holding member 108. Pairs of gears 9, 10, which are meshed with each other and which constitute a drive mechanism for the developing device 12, are arranged on an inner surface of the side plate 7 in correspondence to the respective developing cartridges D. Further, a gear 8 is non-rotatably secured to the central shaft 110 and is meshed with the gears 9, so that a planetary gear mechanism is constituted by the gears, 8, 9 and 10. A recessed member 11 having a U-shaped recess 11*a* is attached to a surface (facing the developing cartridge D) of each gear 10. In the illustrated embodiment, in a condition that the U-shaped recesses 11*a* of the recessed members 11 are oriented horizontally as shown in FIG. 9, the parallel portions 14*a* (now oriented horizontally) of the rotary support shafts 14 of the developing devices 12 of the developing cartridges D mounted on the holding members 108 are fitted into the U-shaped recesses 11*a*.

According to the above-mentioned control mechanism, when the holding members 108 are rotated around the central shaft 110 toward the developing position to shift the developing cartridges D, the supporting side plate 7 is also rotated in the same direction, thereby causing the planetary movement of the gears 8, 9, 10, with the result that the recessed members 11 of the supporting side plate 7 are rotated in reverse or opposite directions to maintain the U-shaped reverses 11*a* in horizontal conditions. Accordingly, the developing devices 12 fitted in the U-shaped recesses via the rotary support shafts 14 are also rotated in the reverse directions (same as the recessed members 11) in the developing cartridge D, so that the developing devices 12 are always maintained in the horizontal conditions, regardless of the movement of the developing cartridges D.

If necessary, when the central shaft 110 of the holding members 108 is rotated by an appropriate drive source (not shown), any postures (for example, inclined postures) of the developing devices 12 in the developing cartridges D can be achieved. In this way, by slidingly inserting the support plates 83 each having a diameter greater than an outer diameter of the developing cartirdge D into the containing recesses 108*b* of the holding members 108, the developing cartridge can easily be mounted on the holding members, and, since there are gaps between the developing device and the containing recesses, the developing device can freely be rotated.

Next, a second embodiment of the present invention will be explained with reference to FIGS. 10 to 13B.

Figure 10:
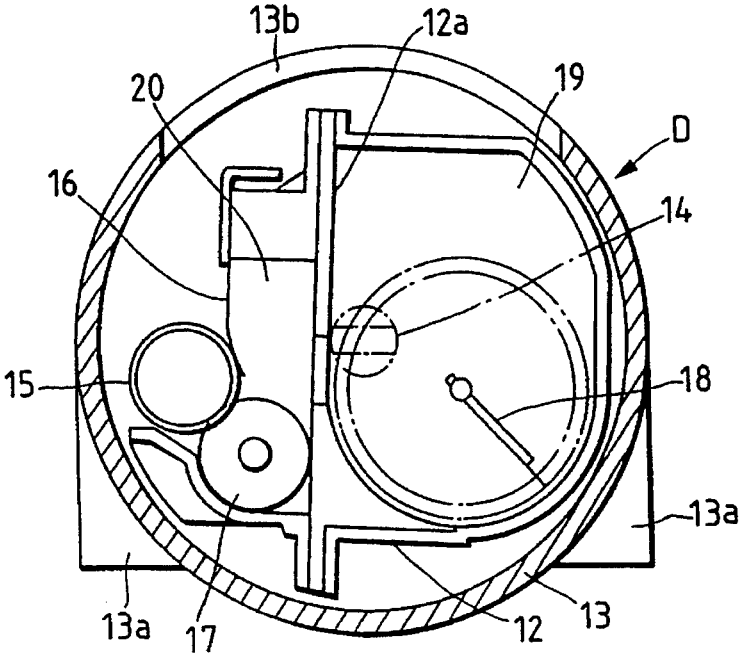
FIG. 10 is a sectional view of a developing cartridge of an image forming apparatus according to a second embodiment of the present invention.
Figure 11:
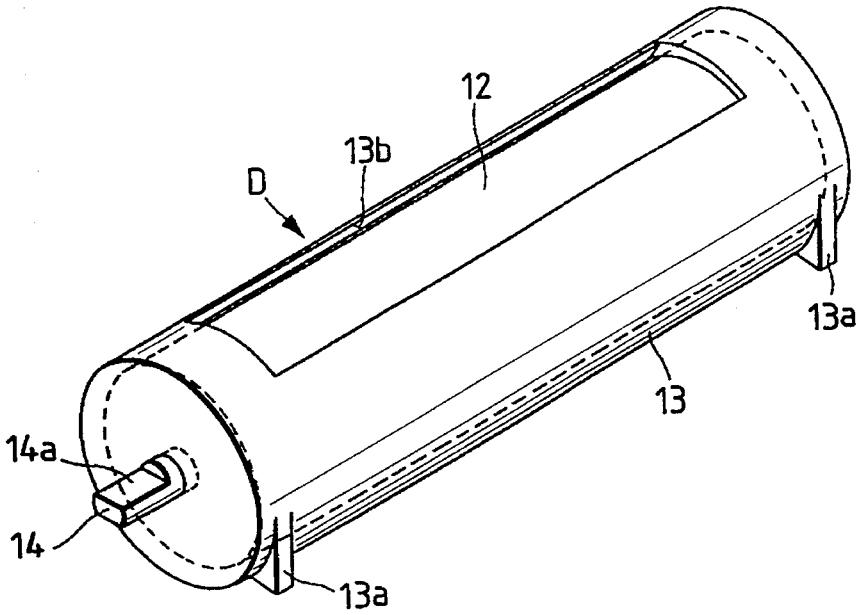
FIG. 11 is a perspective view of the developing cartridge of FIG. 10.

As shown in FIG. 10, in this embodiment, a developing cartridge D comprises a developing device 12, and a cylindrical support container 13 for rotatably containing the developing device 12 via rotary support shafts 14 secured to both ends of the developing device. The rear (that side) rotary support shaft 14 protrudes from an end face of the developing device 12 and is attached to the control mechanism of the developing cartridge switching mechanism as shown in FIG. 9, as is in the first embodiment.

Leg portions 13*a* corresponding to the step 108*a* formed in the containing recesses 108*b* of the holding member 108 shown in FIG. 1 are provided on both sides of both ends of the support container 103, so that the support container 13 of the developing cartridge D contained in the containing recesses 108*b* is non-rotatably held with respect to the holding members 108 by abutting the leg portions 13*a* against the steps 108*a*.

An opening portion 13*b* is formed in a portion of the support container 103 opposite to the leg portions 13*a* so that a developer bearing member 15 of the developing device 12 in the support container 13 can be opposed to the image bearing member 1 when the developing cartridge D is shifted to the developing position. At the developing position opposed to the image bearing member 1, the transmission of a driving force and the electrical connection to the developer bearing member 15 of the developing device 12 can be effected through the opening portion 13*b*. Of course, another opening may be formed in the support container 13 and such transmission and connection may be effected through such another opening.

As is in the first embodiment, each developing cartridge D is contained in and mounted to the containing recesses 108*b* of the holding members 108 by fitting the parallel portion 14*a* of the rotary support shaft 14 into the U-shaped recess 11*a* of the recessed portion 11 provided on the inner surface of the supporting side plate 7 of the control mechanism of the developing cartridge switching mechanism shown in FIG. 9. With this arrangement, the developing cartridges D of different colors can be shifted successively to the developing position opposed to the image bearing member 1; meanwhile, the developing devices are always maintained in predetermined postures, regardless of the movement of the developing cartridges D. In the developing cartridge S positioned in the developing position, the developer bearing member 15 of the developing device 12 is opposed to the image bearing member 1 through the opening portion 13*b* of the support container 13.

Figure 12:
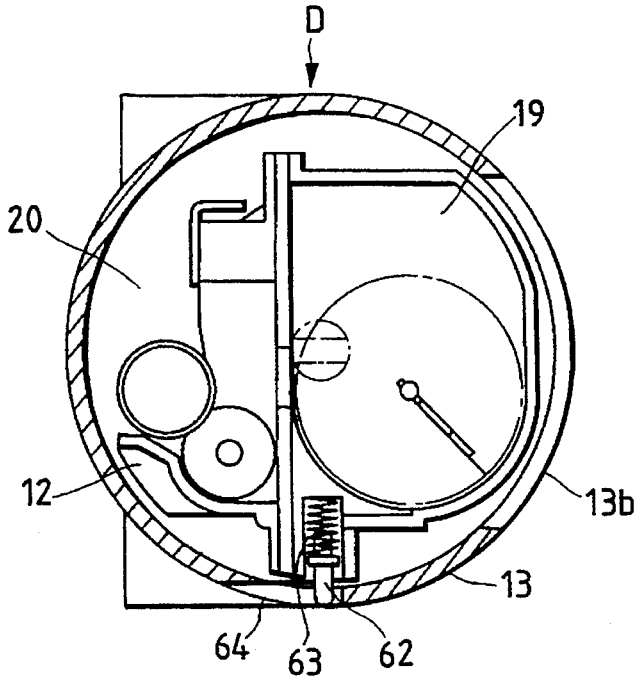
FIG. 12 is a sectional view showing a method for securing a developing device of the developing cartridge to a support container.

According to this embodiment, when the developing cartridges D are mounted to or dismounted from the image forming apparatus or when the developing cartridge D alone is treated or handled, in order to prevent the developing portion 20 of the developing device 12 from exposing through the opening portion 13*b* of the support container 13, as shown in FIG. 12, the developing portion 20 of the developing device 12 is fixed at a non-exposed position opposite to the opening portion 13*b* of the support container 13 by a holding mechanism. And, in such a non-exposed condition, the developing cartridge D is mounted to or dismounted from the holding members 108, and the developing cartridge D alone is stored in such a non-exposed condition before it is mounted to the holding members 108.

As shown in FIG. 12, the holding mechanism comprises a downwardly directing pin 62 provided at a lower portion of the developing device 12 of the developing cartridge D, a spring 63 for biasing the pin 62 downwardly, and a notched portion 64 provided in the proximity of one of the leg portions 13*a* of the support container 13. When the developing cartridge D is not mounted to the image forming apparatus, the pin 62 is fitted into the notched portion 64, thereby non-rotatably fixing the developing portion 20 of the developing device 12 in the non-exposed position in the support container 13.

Figure 13A:
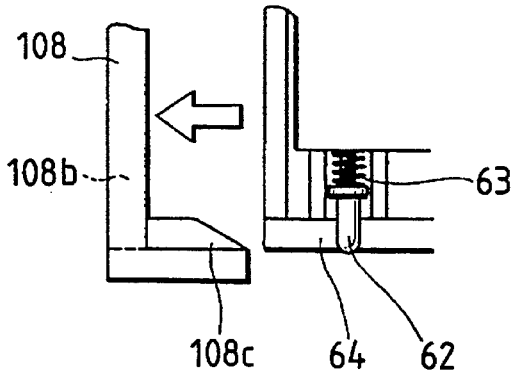
FIGS. 13A and 13B are sectional views showing a condition that the securing is being released by mounting the developing cartridge onto a holding member.
Figure 13B:
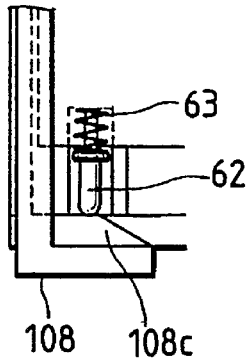

As shown in FIG. 13A, when the developing cartridge D is mounted in the containing recesses 108*b* of the holding members 108, as shown in FIG. 13B, the notched portion 64 of the support container 13 is fitted on a protruded portion 108*c* of the holding member 108, thereby retracting the pin 62 of the developing device 12 upwardly from the notched portion 64 by the protruded portion 108*c*. As a result, the developing cartridge D mounted to the holding members 108 can be rotated with respect to the support container 13.

Figure 14:
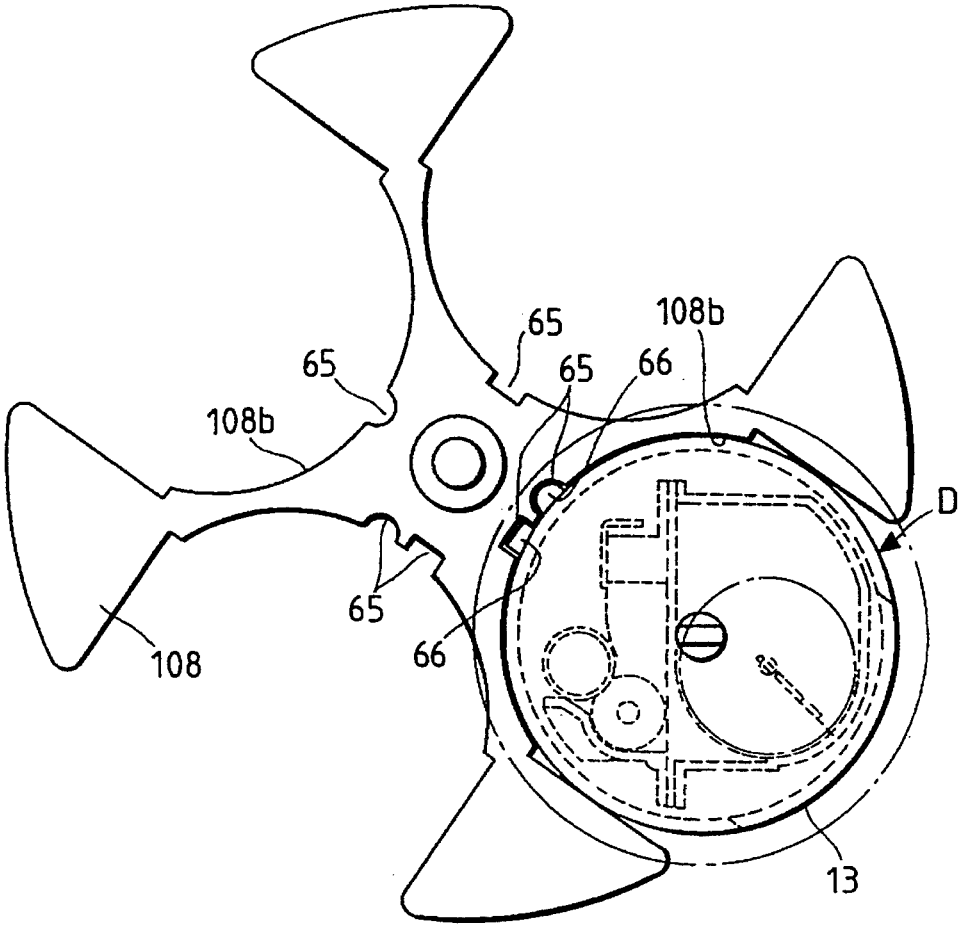
FIG. 14 is a front view showing a developing cartridge holding member and a developing cartridge mounted to the holding member in an image forming apparatus according to a third embodiment of the present invention.

FIG. 14 is a front view showing a developing cartridge holding member 108 and a developing cartridge mounted to the holding member, according to a third embodiment of the present invention.

In this embodiment, semi-circular and/or rectangular key ways 65 are formed in the developing cartridge containing recesses 108*b* of the holding member 108 in such a manner that the shape or the number of the key ways 65 is different from the containing recess to the containing recess. On the other hand, key or keys 66 having the shape or number corresponding to the key way(s) 65 formed in the corresponding containing recess 108*b* are formed on the support container 13 of the developing cartridge D to be inserted into such containing recess.

By judging whether the key(s) 66 can be fitted into the key way(s) 65 or, it is possible to insert a specific developing cartridge D into the corresponding containing recess 108*b*, thereby mounting the former to the latter. Further, since the support container 13 does not rotate, when the developing cartridge D is dismounted from the holding members 108, it is nor required for performing the registration between the key way(s) 65 and the key(s) 66.

Next, a fourth embodiment of the present invention will be explained.

Figure 15:
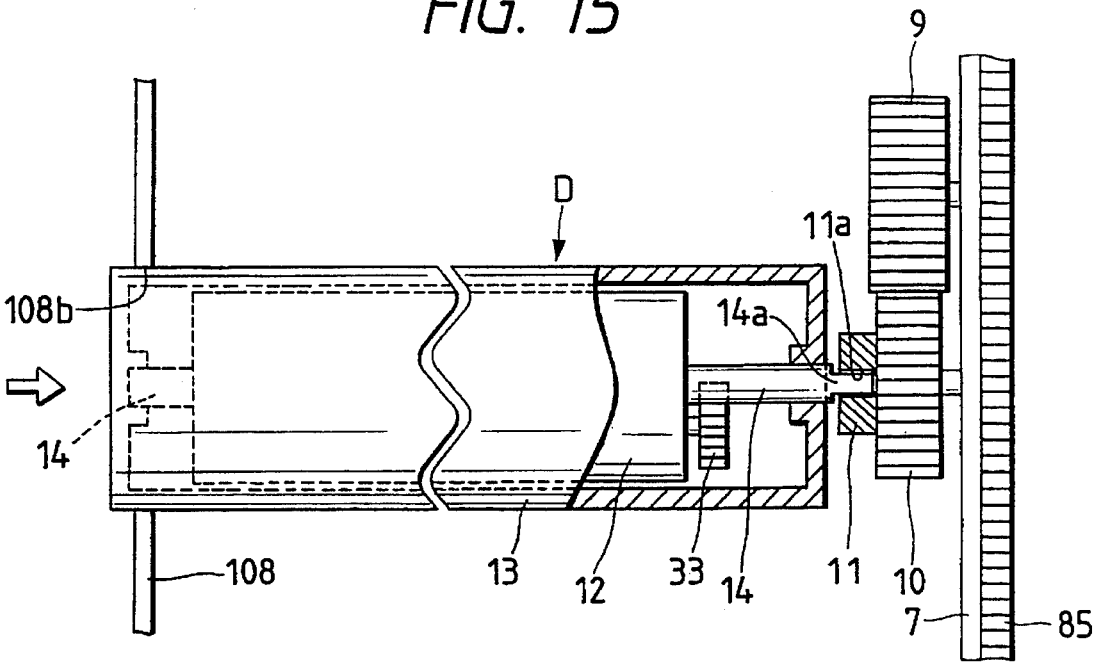
FIG. 15 is a side view, partially in section, showing a method for mounting a developing cartridge to a holding member in an image forming apparatus according to a fourth embodiment of the present invention.

FIG. 15 is a side view, partially in section, showing a method for mounting a developing cartridge, according to the fourth embodiment of the present invention. The whole construction of this fourth embodiment is fundamentally the same as that of the first embodiment.

In this fourth embodiment, as is in the second embodiment, as shown in FIG. 10, a developing cartridge D comprises a developing device 12, and a cylindrical support container 13 for rotatably containing the developing device 12 via rotary support shafts 14 secured to both ends of the developing device. As shown in FIG. 15, the developing cartridge D is mounted on the holding members 108 of the developing cartridge switching mechanism by inserting the developing cartridge into the containing recesses 108*b* of the holding members 108.

Figure 16:
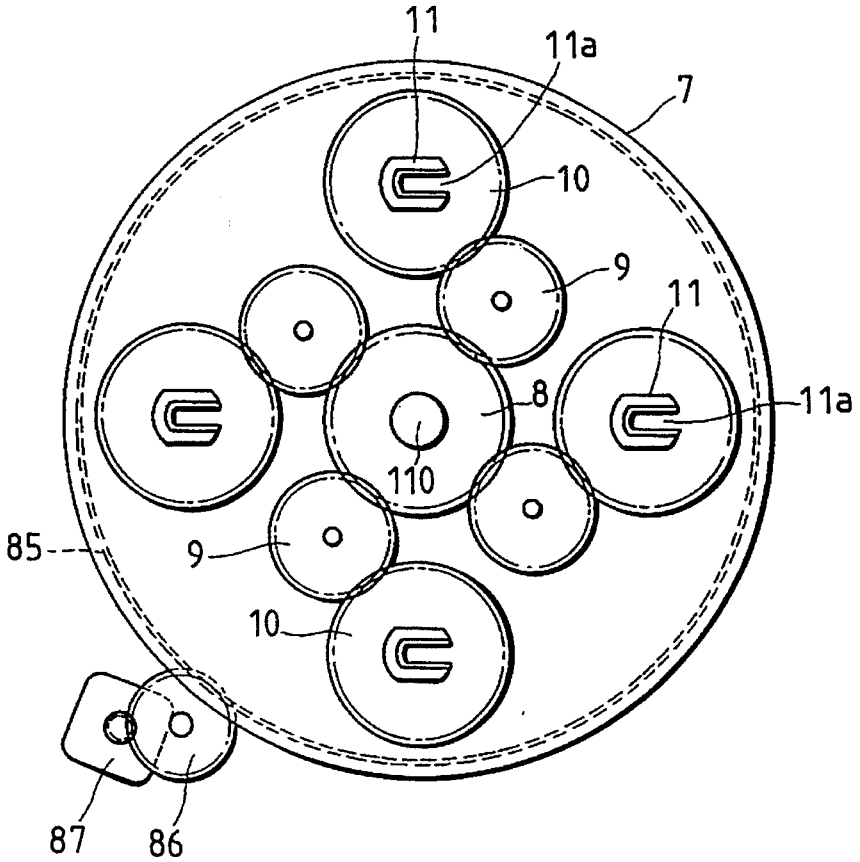
FIG. 16 is a front view showing a developing device drive mechanism and a side plate of a developing cartridge switching mechanism.

As shown in FIG. 16, the developing cartridge switching mechanism comprises a plate-shaped developing device drive mechanism supporting side plate 7 rotated integrally with the holding member 108 around the non-rotatable central shaft 110 of the holding member 108. As shown in FIGS. 15 and 16, a gear 85 for driving the supporting side plate 7 is provided on an outer surface of the side plate 7. The supporting side plate 7 is driven by a cartridge shifting motor (rotation switching motor) 87 via a gear 86 meshed with the gear 85.

As is in the first embodiment, gears 9, 10 which are meshed with each other and a gear 8 secured to the central shaft 110 and meshed with the gears 9, which constitute a drive mechanism for the developing device 12 are arranged on an inner surface of the side plate 7. A planetary gear mechanism for controlling postures of the developing devices 12 is constituted by these gears 8, 9 and 10. After the rotary support shafts 14 protruded from the support containers 13 of the developing devices 12 are fitted into U-shaped recesses 11*a* of recessed members 11 formed on the respective gears 10, by rotating the developing devices 12 by means of the planetary gear mechanism, the postures of the developing devices 12 are controlled.

Figure 17:
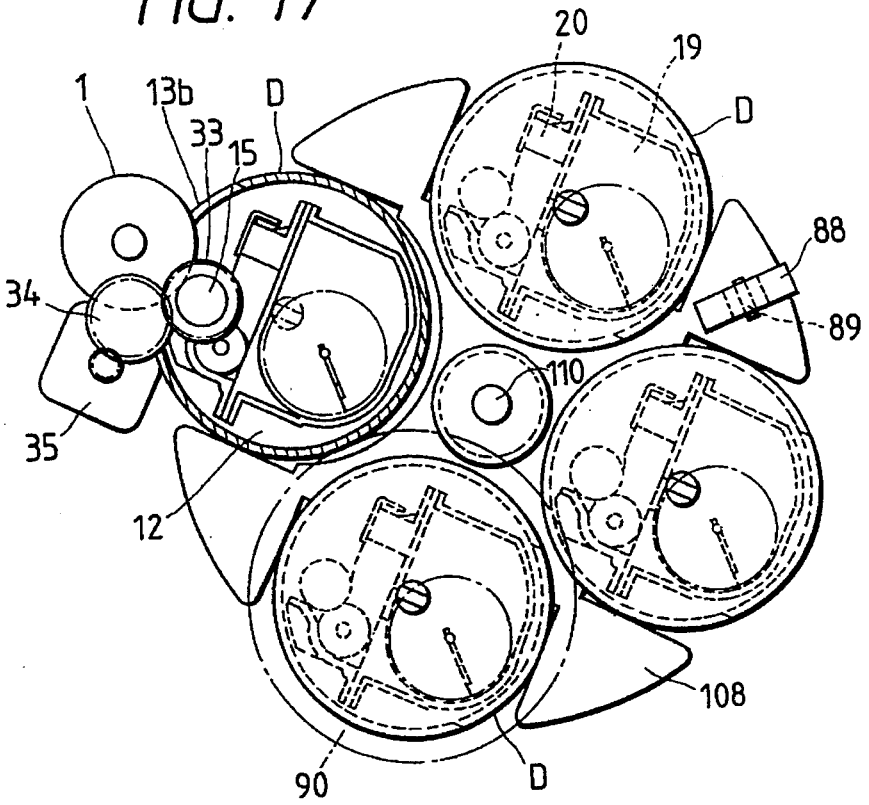
FIG. 17 is a sectional view showing a method for driving a driven portion of the developing cartridge and the developing cartridge switching mechanism.

As shown in FIG. 17, when one of the developing cartridges D is positioned at the developing position opposed to the image bearing member 1, a gear 34 of the image forming apparatus is meshed with a gear 33 provided on the developer bearing member 15 of the developing device 12 through the opening portion 13*b* of the support container 13 of the developing device 12, thereby driving the developing device by a drive source 32 of the image forming apparatus. In this case, a flag (revolution position flag) 89 for detecting the revolution position of the developing cartridge D is provided on the holding member 108, and a revolution position sensor 88 associated with the revolution position flag 89 is arranged in the image forming apparatus. When the developing cartridge D is changed, by detecting the passage of the revolution position flag 89 by the revolution position sensor 88, a given developing cartridge D is shifted to the developing position or to a developing cartridge exchanging opening 90 formed in the outer plate of the image forming apparatus, on the basis of the detected position as a reference.

Figure 19:
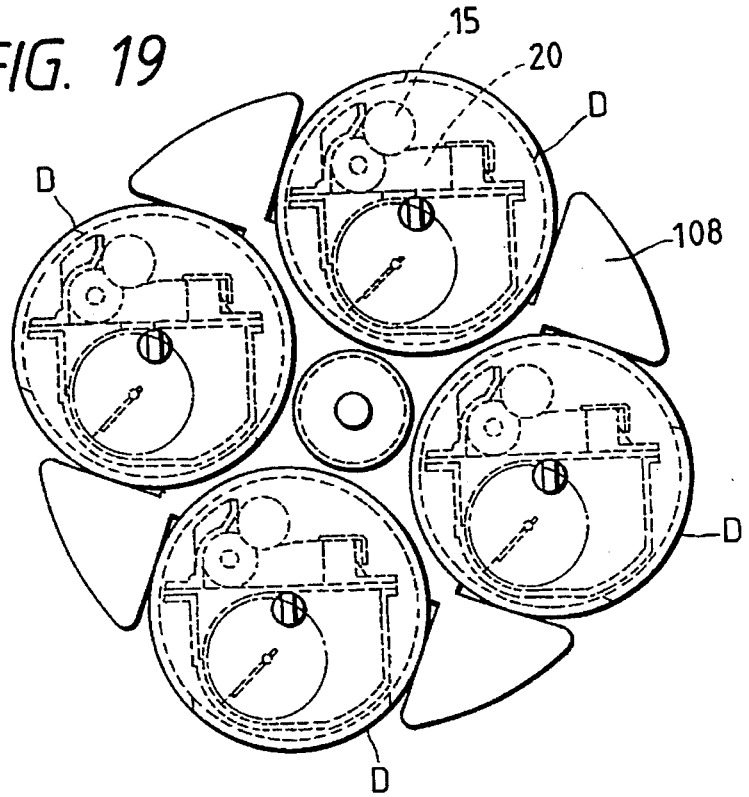
FIG. 19 is a front view of the developing cartridge a posture of which is oriented upwardly by the control mechanism of FIG. 18.
Figure 18:
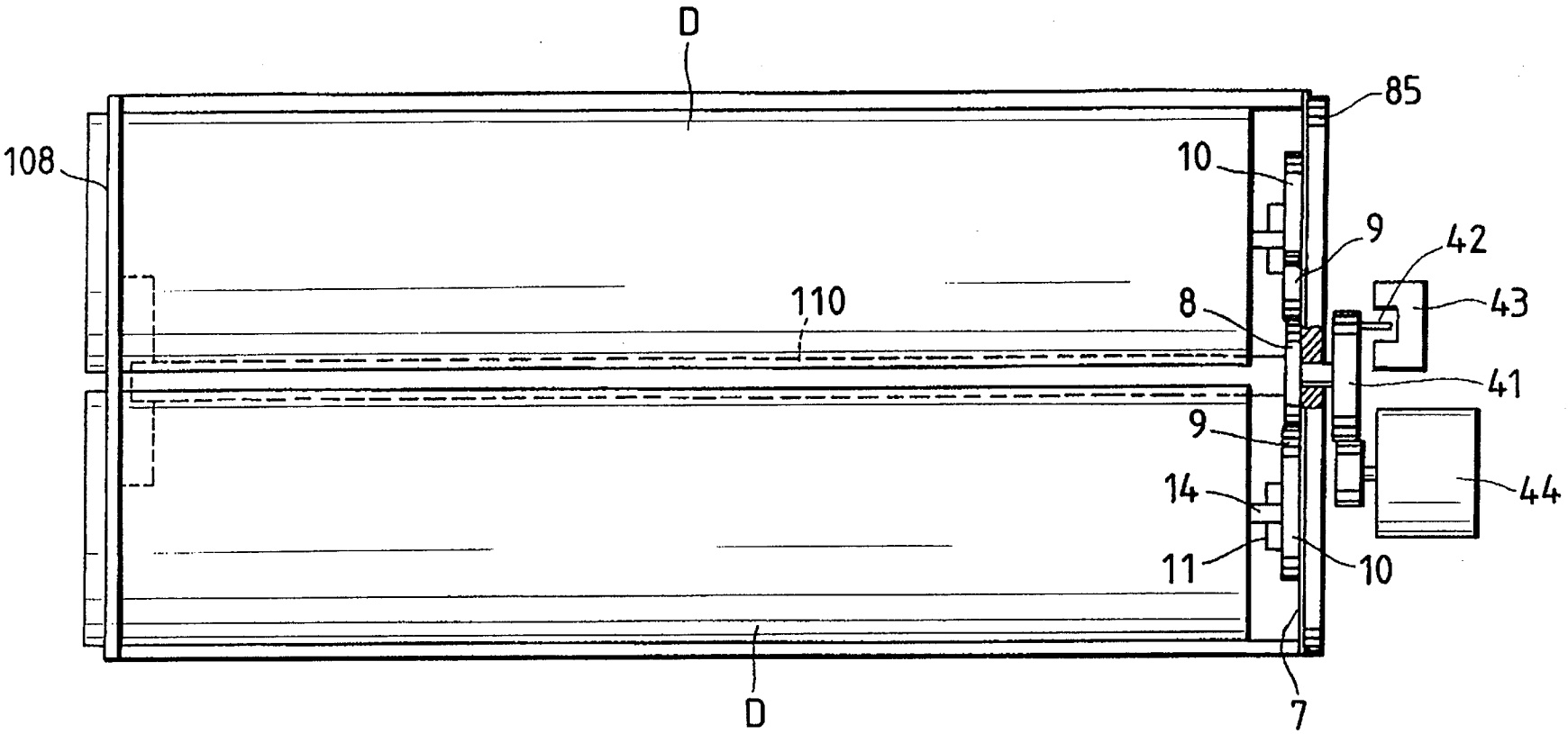
FIG. 18 is a front view of another posture control mechanism provided in the developing cartridge switching mechanism.

As shown in FIG. 18, a gear 41 secured to a gear shaft of the central gear 8 (forming a part of the planetary gear mechanism for effecting the posture control of the developing devices 12) of the supporting side plate 7 is rotated together with the central gear 8, and this gear 41 is driven by a motor (posture control motor) 44. The gear 41 is provided with a flag 42 for providing a reference for the posture control in correspondence to the stop position of the gear 41, which flag 42 is detected by a posture control sensor 43 arranged in the image forming apparatus. The postures of the developing cartridges are controlled in such a manner that the developing cartridges D are inclined by a given angle toward their toner containing portions 19 in the developing operation as shown in FIG. 17, and the developing portions 20 including their developer bearing members 15 are oriented upwardly in the revolutional switching operation during the non-developing operation as shown in FIG. 19, thereby preventing the leakage and scattering of the toner.

Figure 20:
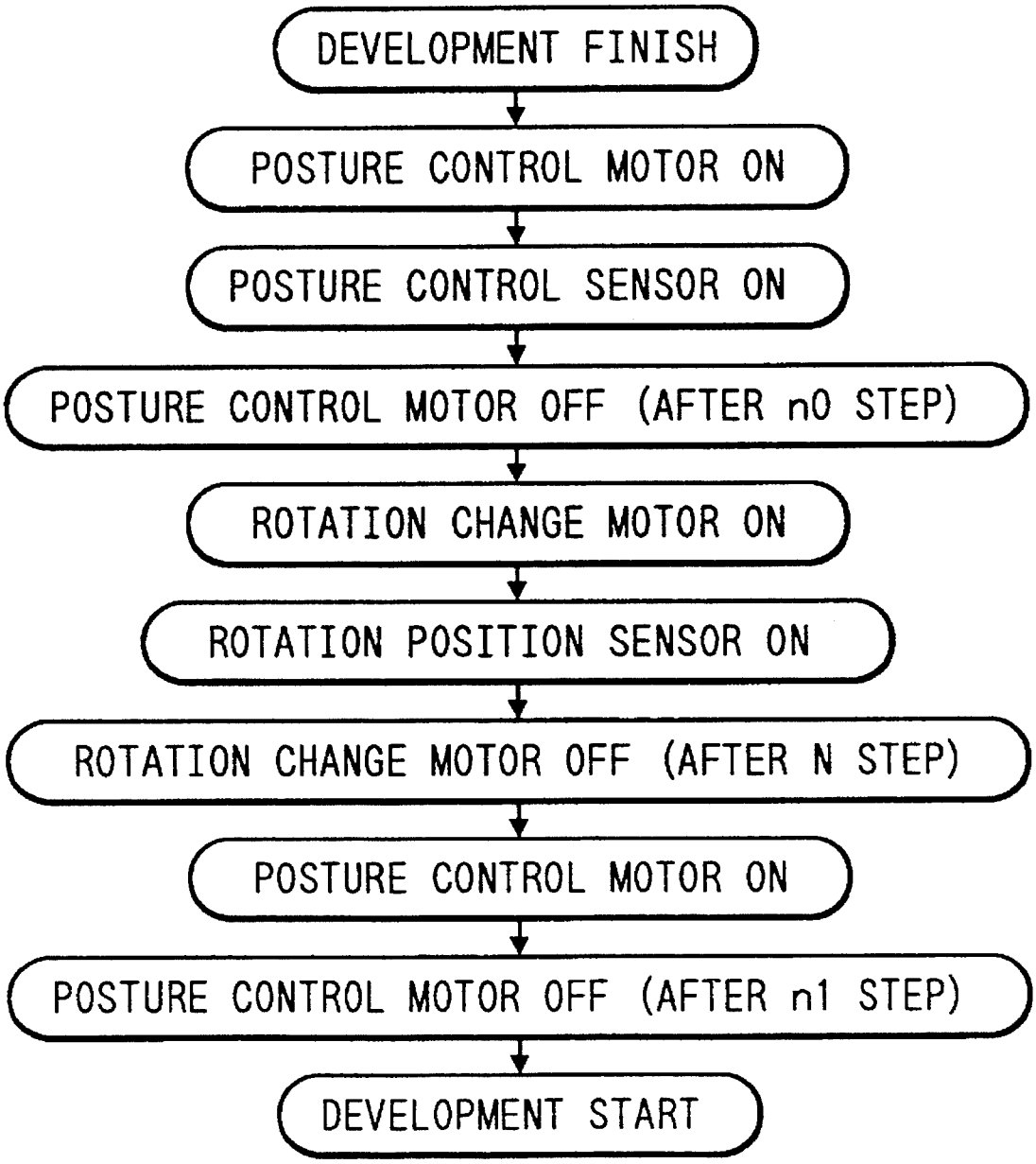
FIG. 20 is a control flowchart.

As shown in a flowchart of FIG. 20, after the developing operation is finished, the posture control motor 44 is turned ON. Then, after the data $n_0$ step stored in a ROM of a control device (not shown) is elapsed from an ON signal of the posture control sensor 43, the posture control motor 44 is stopped. At this point, the developing cartridges D assume the postures wherein the respective developing portions 20 are oriented upwardly as shown in FIG. 19. Then, when the developing operation with different color toner is performed, the rotation (revolution) change (switching) motor 87 is rotated, and the developing cartridge D selected on the basis of the signal of the rotation (revolution) position sensor 88 is shifted to the developing position. Then, the posture control motor 44 is rotated. After the data $n_1$ step stored in the ROM of the control device (not shown) is elapsed, the posture control motor 44 is stopped, thereby attaining the inclined developing postures of the developing cartridges D (FIG. 17).

Next, a fifth embodiment of the present invention will be explained with reference to FIGS. 21A–21C, 22 and 23.

Figure 22:
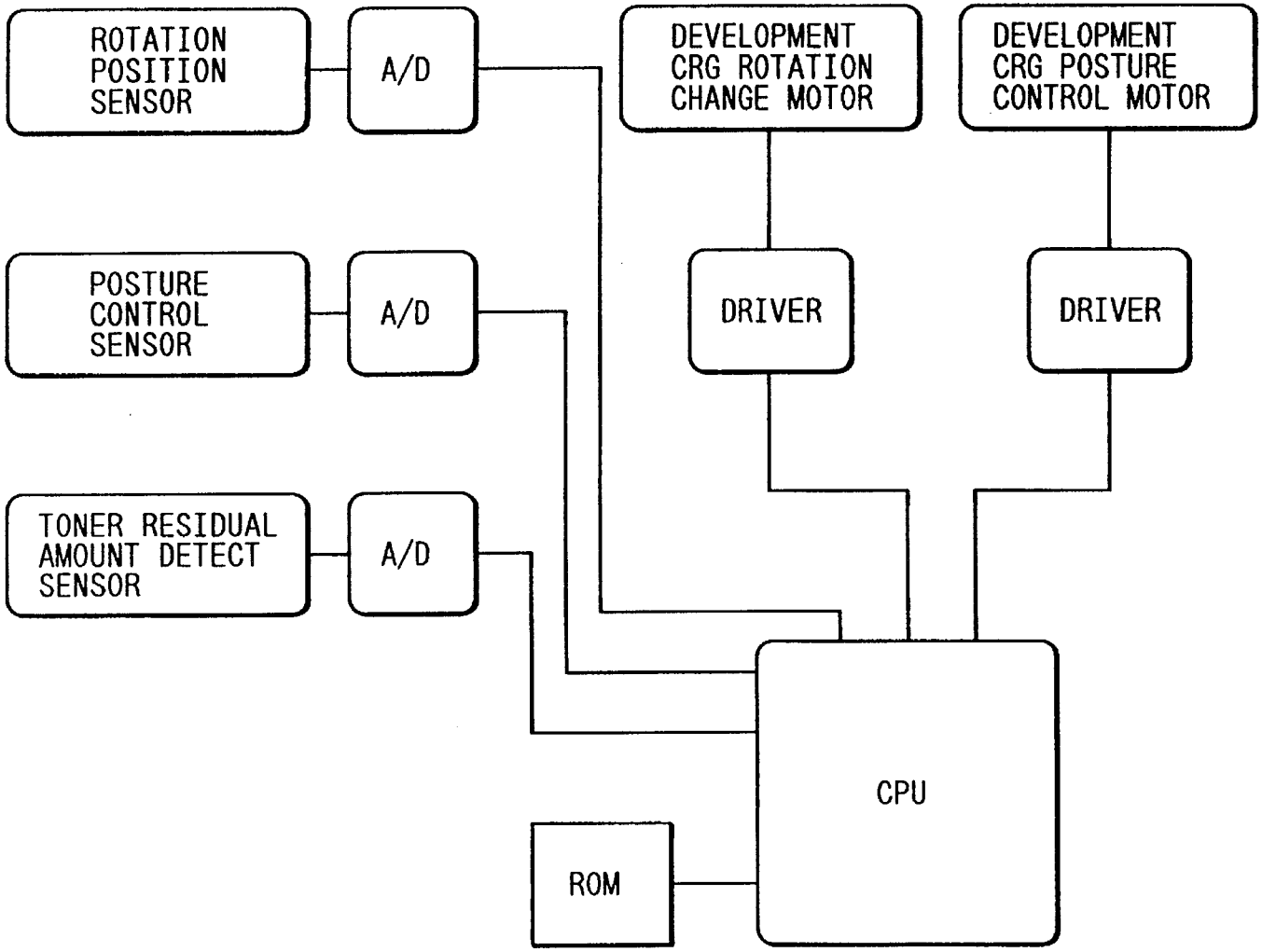
FIG. 22 is a block diagram of a control mechanism for the posture control.
Figure 23:
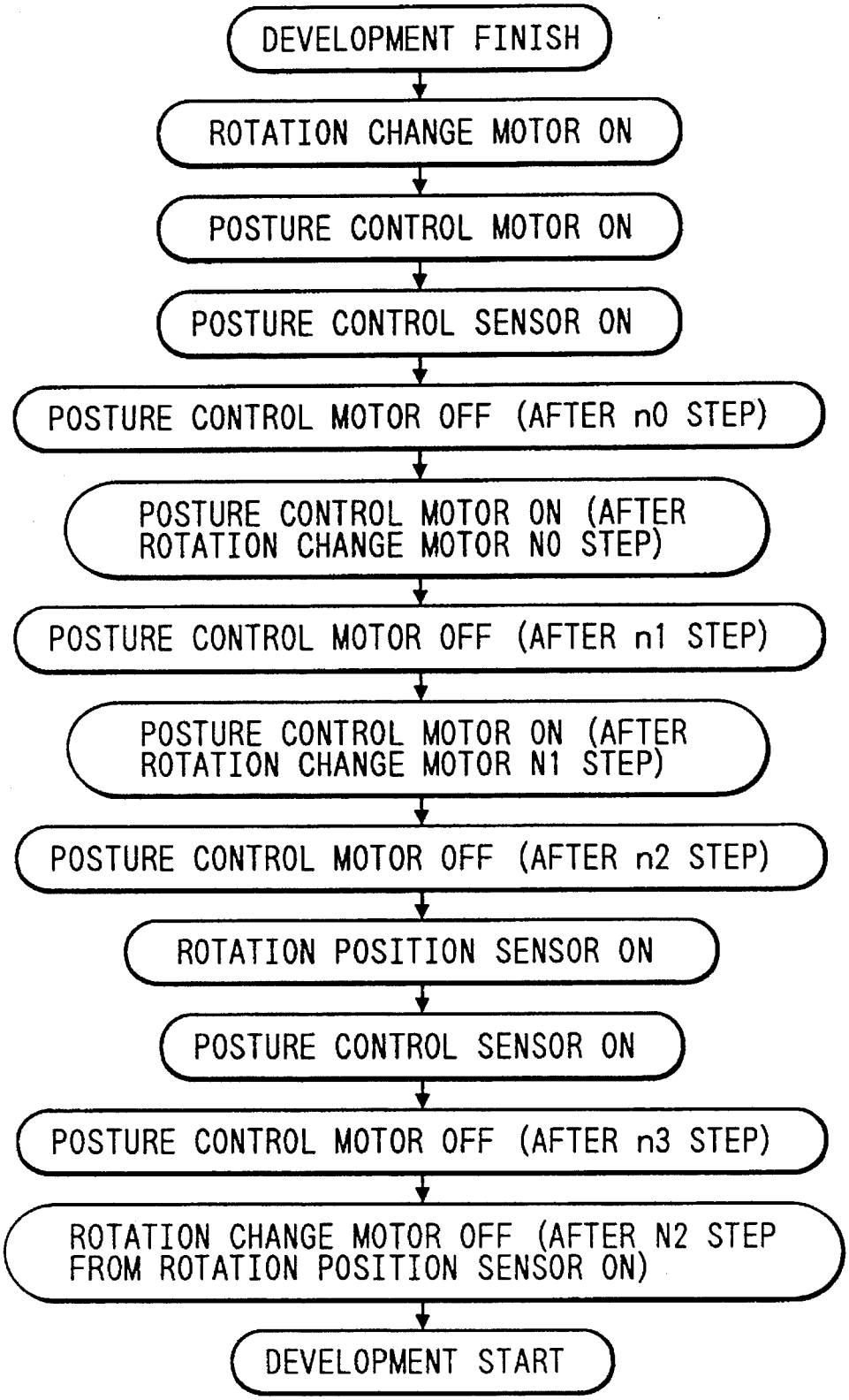
FIG. 23 is a control flowchart.

In this embodiment, after the development with the first color is finished, as shown in a flowchart of FIG. 23, the rotation change motor 87 of FIG. 16 is rotated, thereby starting the rotation change operation. Then, the posture control motor 44 of FIG. 18 is rotated, thereby shifting the developing cartridges D from a horizontal developing posture shown in FIG. 21A to an upwardly oriented posture shown in FIG. 21B. This shifting is detected by the posture control sensor 43. Then, after the data $n_0$ step stored in a ROM shown in FIG. 22 is elapsed, the posture control motor 44 is stopped. At this point, the developing cartridges D assume the upwardly oriented postures, thereby returning the toner from each developing portion 20 to each toner containing portion 19 once.

Figures 21A, 21B, 21C:
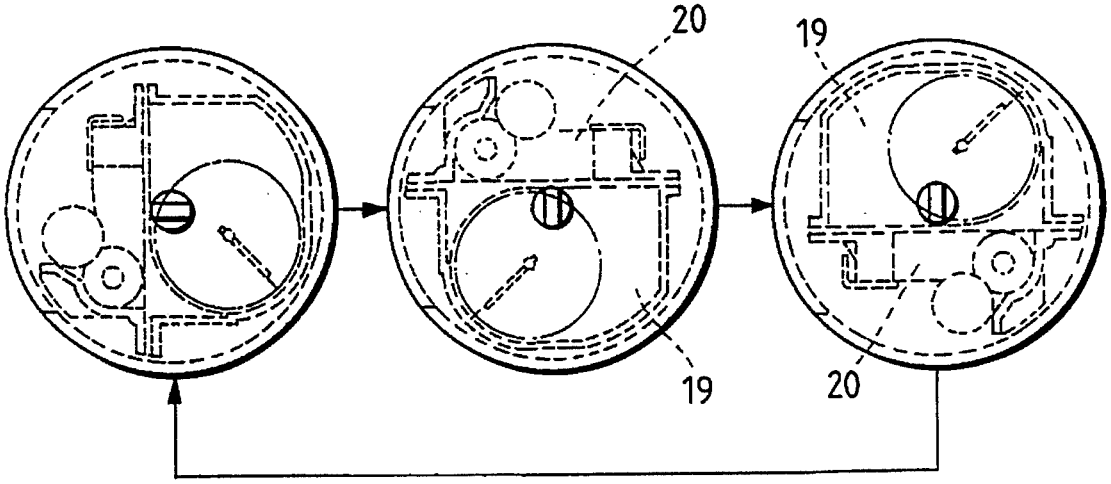
FIGS. 21A to 21C are front views showing a posture control of a developing device of a developing cartridge in an image forming apparatus according to a fifth embodiment of the present invention.

When the developing cartridges D are shifted to their developing postures again, the posture control motor 44 is rotated again, thereby shifting the developing cartridges D to a downwardly oriented posture shown in FIG. 21C, so that the toner is fed from each toner containing portion 19 to each developing portion 20 (after $n_1$ step is elapsed, the motor 44 is stopped). Then, the posture control motor 44 is rotated again, and, after $n_2$ step is elapsed, the motor 44 is stopped again, thereby returning the developing cartridges D to the horizontal developing posture shown in FIG. 21A. Then, the rotation change motor 87 is turned ON to shift the desired developing cartridge S to the developing position. Then, the rotation change motor 87 is stopped.

Next, a sixth embodiment of the present invention will be explained with reference to FIGS. 24 and 25.

Figure 24:
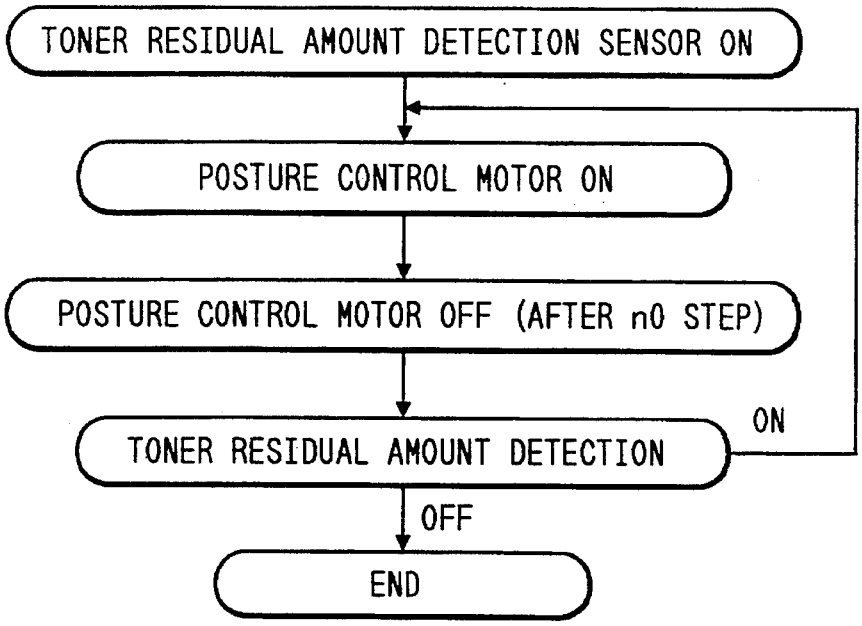
FIG. 24 is a flowchart showing a method for performing a posture control of a developing cartridge in an image forming apparatus according to a sixth embodiment of the present invention.
Figures 25A, 25B:
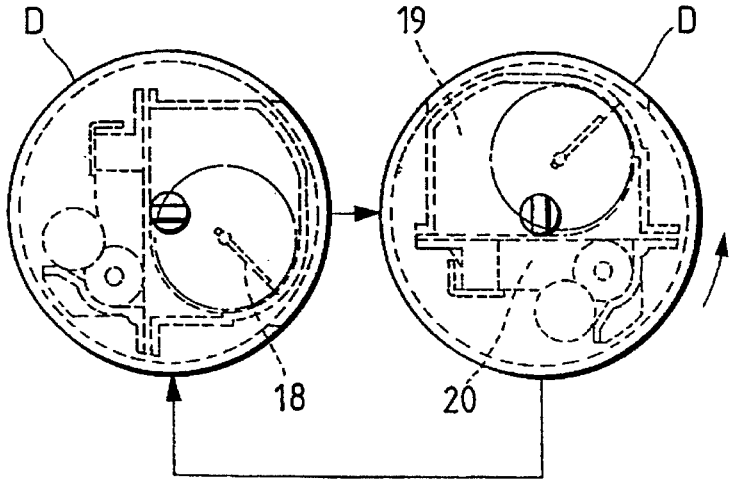
FIGS. 25A and 25B are front views showing the change in the posture of the developing cartridge effected by the control of FIG. 24.

As shown in a flowchart of FIG. 24, when a toner residual amount detection sensor for detecting the residual amount of toner in the toner containing portion 19 of the developing device 12 of the developing cartridge D is turned ON, the posture control motor 44 of FIG. 18 is rotated to rotate the developing cartridge D by one revolution or more from a horizontal posture shown in FIG. 25A to a downwardly oriented posture shown in FIG. 25B. As a result, the toner remaining in the toner containing portion 19 (not fed by the toner agitating member 18) can be fed to the developing portion 20, thereby effectively utilizing the toner.

Incidentally, the posture control operation of each developing cartridge D may be not effected by mere rotation of the developing cartridge, but may be effected by repeating the normal and reverse rotations of the developing cartridge from the downwardly oriented posture shown in FIG. 25B, thereby feeding the toner from the toner containing portion 19 to the developing portion 20.

Next, a seventh embodiment of the present invention will be explained with reference to FIGS. 26 and 27.

Figure 26:
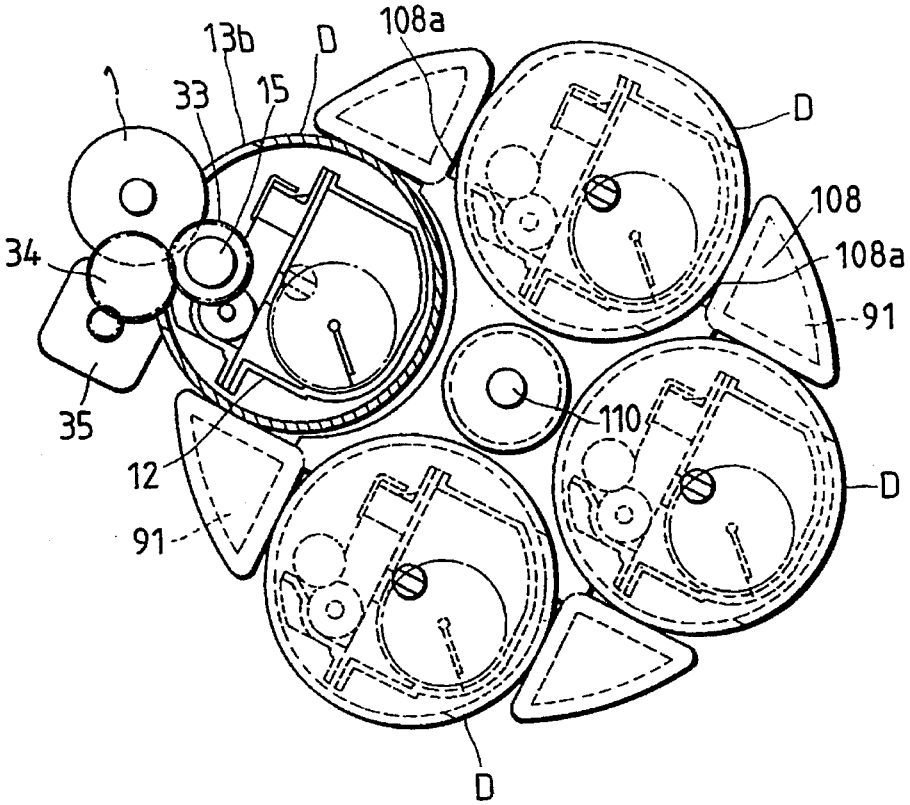
FIG. 26 is a front view of a developing cartridge and a switching mechanism therefor in an image forming apparatus according to a seventh embodiment of the present invention.

As shown in FIG. 26, when the developing cartridge D is positioned at the developing position opposed to the image bearing member 1, a gear 34 of the image forming apparatus is meshed with a gear 33 provided on a developer bearing member 15 of a developing device 12 through an opening portion 13*b* of a support container 13 of the developing device 12, thereby driving the developing device by a drive source 35 of the image forming apparatus.

A developing cartridge switching mechanism comprises holding members 108, a supporting side plate of FIG. 16, and four connection members 91 connecting the holding members and the side plate. Each developing cartridge D is held by a gear 10 having a recessed member 11 into which a rotary support shaft 14 of the support container 13 is fitted and the connection members 91 at the side of the supporting side plate 7, and is held by a sheet member 47 tensioned by springs 46 in front of developing cartridge containing recesses 108*b* of the holding member 108 at the side of the holding member 108 as shown in FIG. 27.

Figure 27:
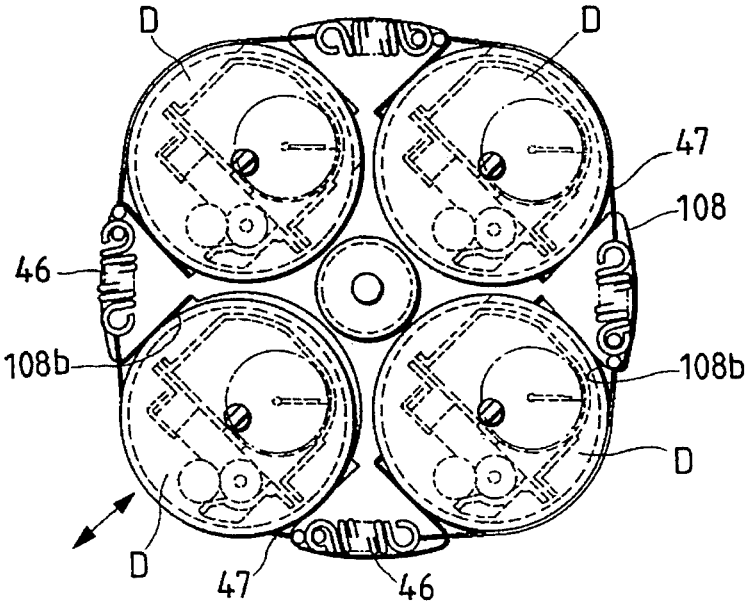
FIG. 27 is a front view showing a condition that a sheet member is mounted on a holding member of the developing cartridge switching mechanism.

With this arrangement, by positioning a direction that an opening of a recess 11*a* of the recessed member 11 of the gear 10 is coincident with the opening of the developing cartridge containing recess 108*b* of the holding member 108 toward the image bearing member 1, as shown in FIG. 27, the developing cartridge D can be positioned with respect to the image bearing member 1 by the sliding movement.

Next, an eighth embodiment of the present invention will be explained with reference to FIGS. 28 and 29.

Figure 28:
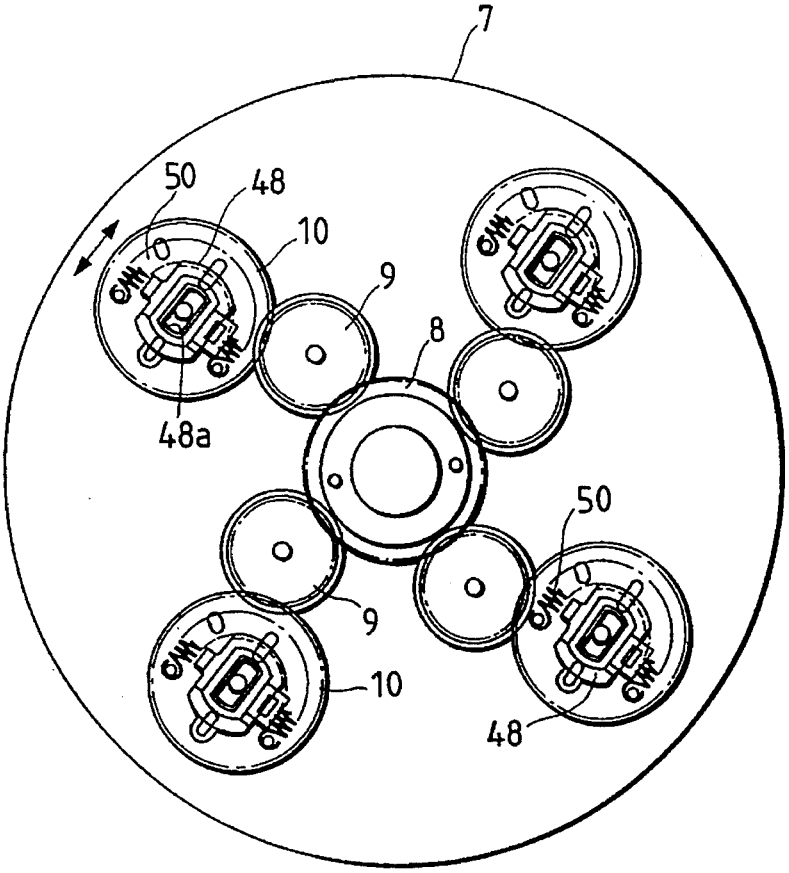
FIG. 28 is a front view showing a developing device drive mechanism supporting side plate of a developing cartridge switching mechanism in an image forming apparatus according to an eighth embodiment of the present invention.
Figure 29:
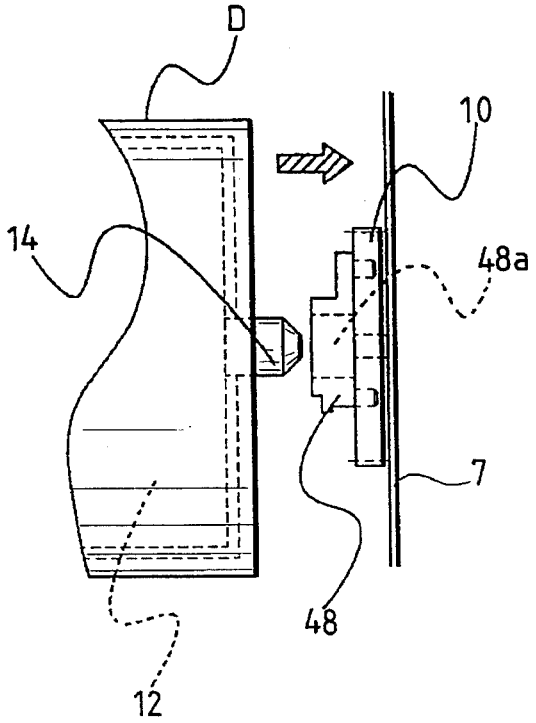
FIG. 29 is a side view showing a condition that a rotary shaft of a developing device of a developing cartridge is being fitted in a coupling member provided on the side plate of FIG. 28.

As shown in FIGS. 28 and 29, a coupling member 48 is arranged on each of developing device rotary drive gears 10 mounted on a supporting side plate 7 of a developing cartridge switching mechanism so that the coupling member can be rotated integrally with the corresponding gear 10 and can be slidable with respect to the gear 10. A rotary support shaft 14 of each developing device 12 is fitted in a hole 48*a* of the corresponding coupling member 48, thereby permitting the rotational movement of the developing device 12 and the sliding movement of the developing cartridge D toward the image bearing member 1.

Further, a spring 50 is wound around each coupling member 48 and serves to return the slidingly shifted developing cartridge D and to hold the respective coupling member 48 at a predetermined position on the corresponding gear 10 to thereby facilitate the fitting of the rotary support shaft 14 of the developing device 12 during the mounting of the developing cartridge switching mechanism.

Next, a ninth embodiment of the present invention will be explained with reference to FIGS. 30 to 32.

Figure 30:
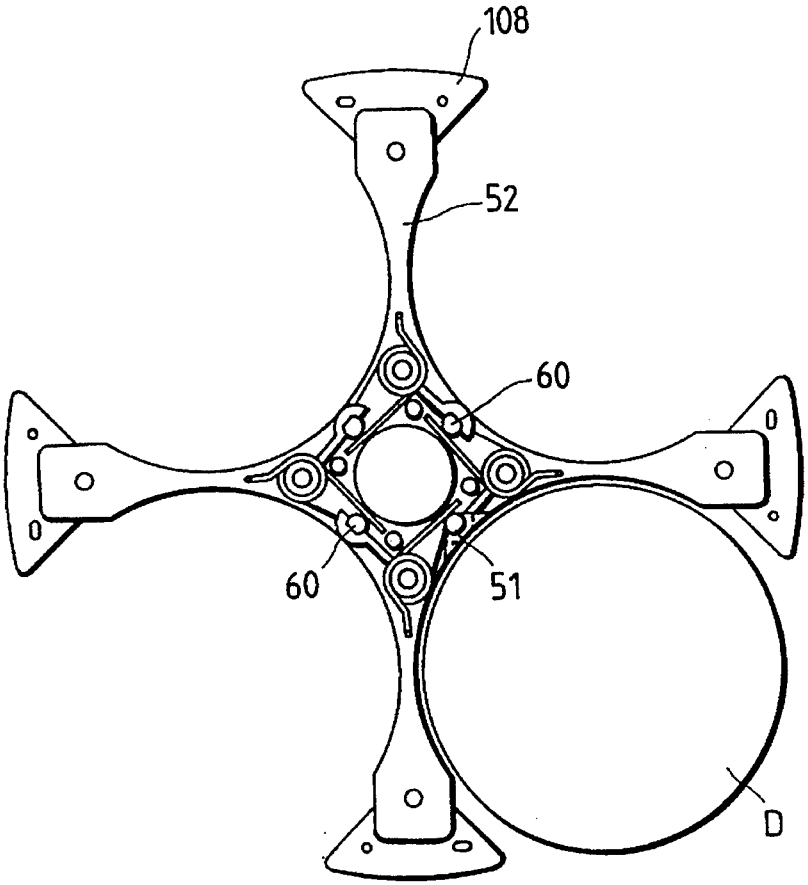
FIG. 30 is a front view showing a condition that a developing cartridge switching mechanism is secured to a holding member in an image forming apparatus according to a ninth embodiment of the present invention.
Figure 31A:
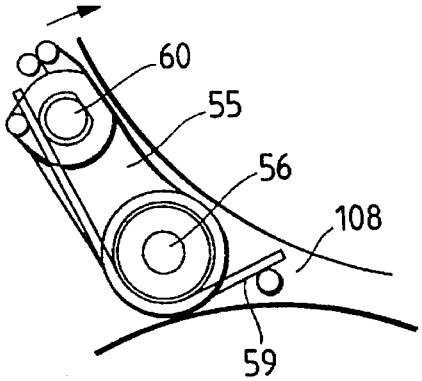
FIGS. 31A and 31B are views showing a developing cartridge holding mechanism for performing the securing of FIG. 30.
Figure 31B:
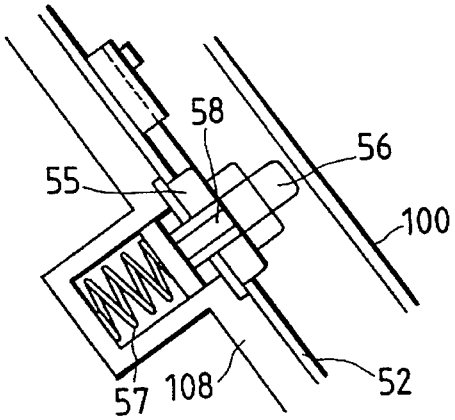
Figure 32:
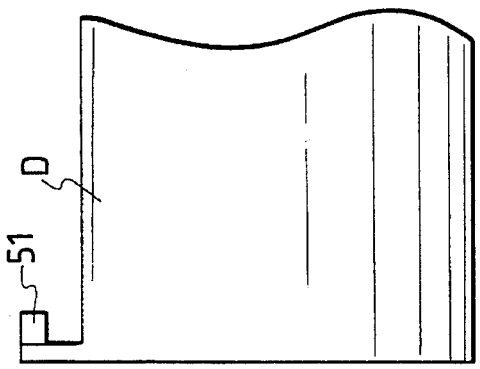
FIG. 32 is a side view of a securing hook provided on a developing cartridge.

In this embodiment, a developing cartridge holding mechanism as shown in FIGS. 31A and 31B is provided on a holding member 108 of developing cartridge switching mechanism, and, as shown in FIGS. 30 and 32, a hook 51 is formed on a developing cartridge D in correspondence to the developing cartridge holding mechanism. The developing cartridge holding mechanism comprises a hook arm 55, a stopper pin 56 disposed at a rotational center of the arm 55, a pressure spring 57 for urging the pin 56, a return spring 59 for returning the hook arm 55, and a lid member 52 for attaching the mechanism to the holding member 108.

The stopper pin 56 is non-rotatable with respect to the holding member 108 but is slidable along the pressure spring 57. The pin 56 is provided with a projection 58 which is fitted in a recess formed in the hook arm 55 in a condition shown in FIGS. 31A and 31B, thereby preventing the rocking movement of the hook arm 55. The hook arm 55 is provided with a hole 60 by which the hook 51 of the developing cartridge D is engaged, thereby fixing the developing cartridge D to the holding member 108 via the hook arm 55.

A cam (not shown) is provided on the side plate 100 of the image forming apparatus at the developing position, in correspondence to the stopper pin 56 of the hook arm 55 holding the developing cartridge D positioned at the developing position. When the pin 56 is pressed down by the cam, the hook arm 55 is disengaged from the pin 56 to permit the rotation of the hook arm 55, thereby permitting the sliding movement of the developing cartridge D toward the image bearing member 1 via the hook arm 55.

Next, a tenth embodiment of the present invention will be explained with reference to FIGS. 33 to 39.

Figure 33:
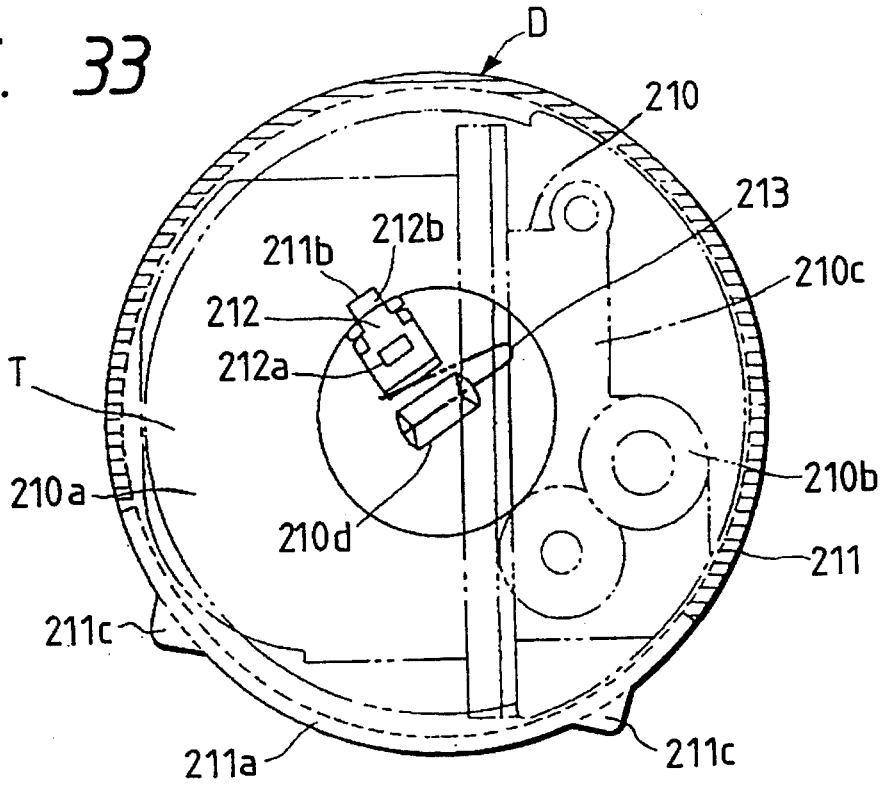
FIG. 33 is a front view of a developing cartridge in an image forming apparatus according to a tenth embodiment of the present invention.
Figure 34:
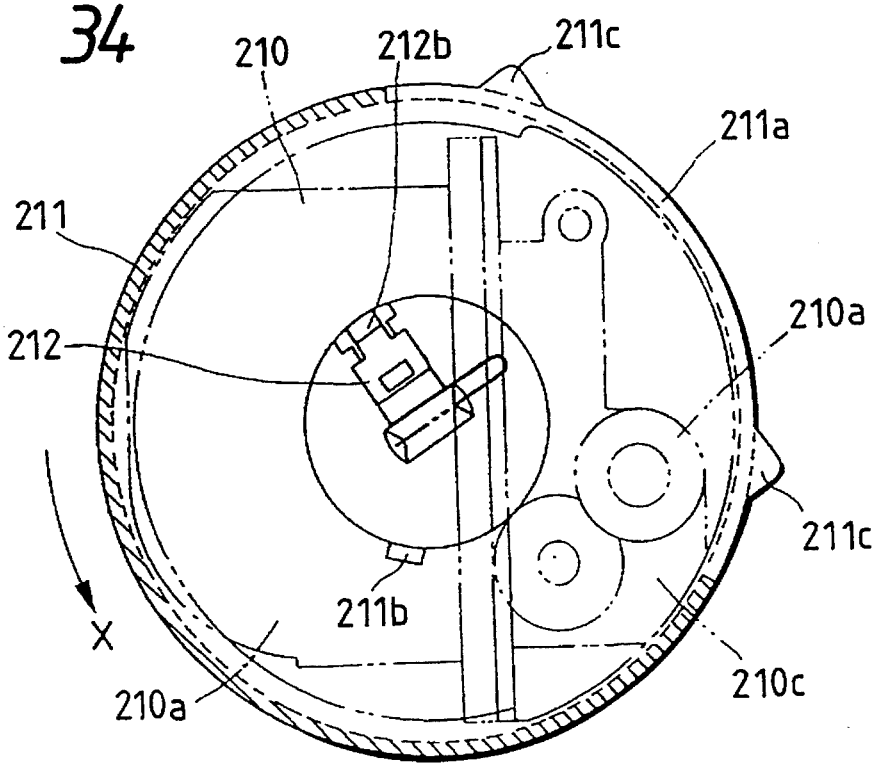
FIG. 34 is a front view showing a condition that a developing posture of the developing cartridge of FIG. 33 is achieved after the cartridge is mounted on a switching mechanism of the image forming apparatus.

As shown in FIG. 33, each developing cartridge D comprises a developing device 210 integrally including a toner containing portion 210*a* containing toner (one-component developer) T and a developing portion 210*c* having a developing sleeve 210*b* to which the toner is supplied from the toner containing portion 210*a*, a substantially cylindrical support container 211 having an opening portion 211*a* at its peripheral surface and adapted to contain the developing device 210 and to support the developing device for relative rotational movement around an axis parallel to a rotary shaft of the developing sleeve 210*b*, and a lock member 212 shiftably held in the proximity of a center of an end face of the developing device 210 and always biased by a spring member 213 radially outwardly of the developing device 210.

Figure 35:
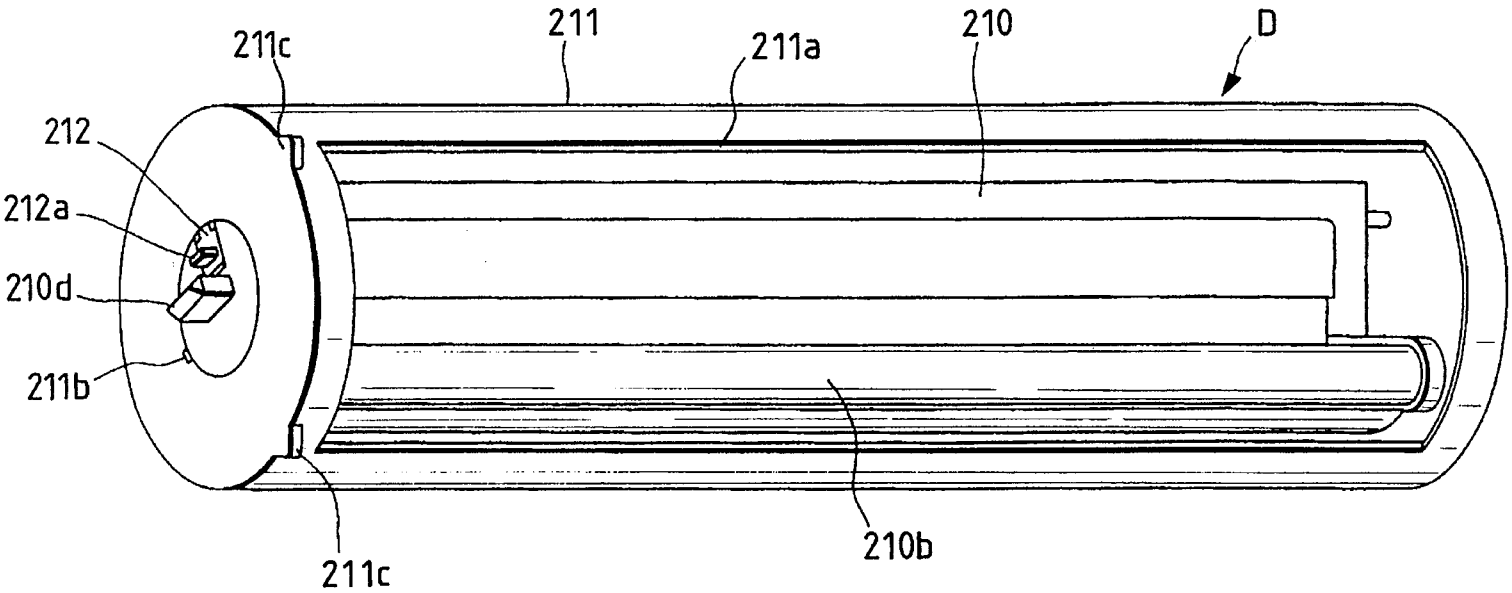
FIG. 35 is a perspective view of the developing cartridge of FIG. 33.

As shown in FIG. 35, a circular hole is formed in an end face of the support container 211, which circular hole is provided with a notch 211*b* into which a pawl 212*b* (FIG. 38) of the lock member 212 is fitted as shown in FIG. 33. When the developing cartridge D is not mounted to the image forming apparatus, by fitting the pawl 212*b* of the lock member 212 in the notch 211*b* by a biasing force of the spring member 213, the developing device 210 is engaged by the support container 211 to lock them in the non-rotating condition, and, as shown in FIG. 33, the developing device 210 is positioned out of phase with the opening portion 211*a* of the support container 211. That is to say, in this case, the developing sleeve 210*b* is covered by the peripheral wall of the support container 211, thereby preventing the scattering of toner and the damage of the developing sleeve 210*b*.

Figure 36:
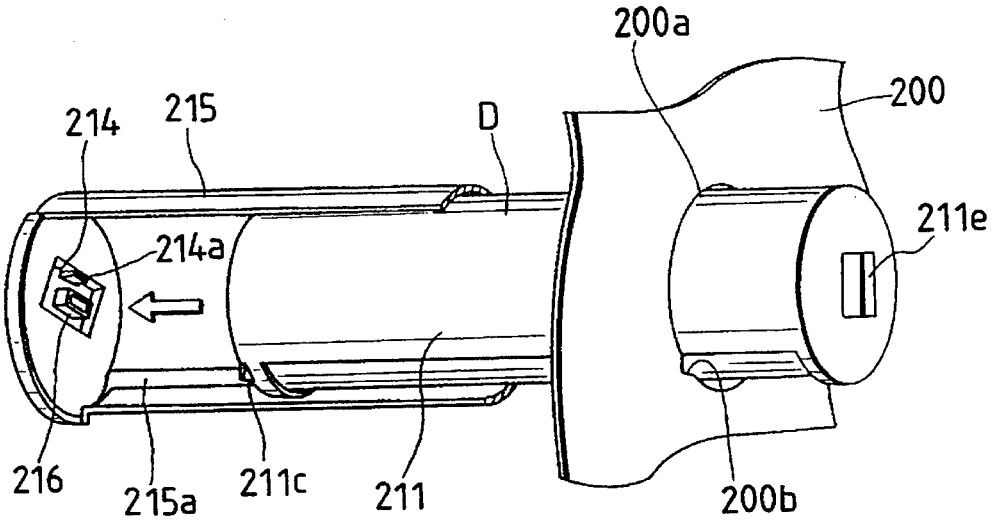
FIG. 36 is a perspective view showing a condition that the developing cartridge of FIG. 33 is being mounted on a rotary member of the developing cartridge switching mechanism.
Figure 37:
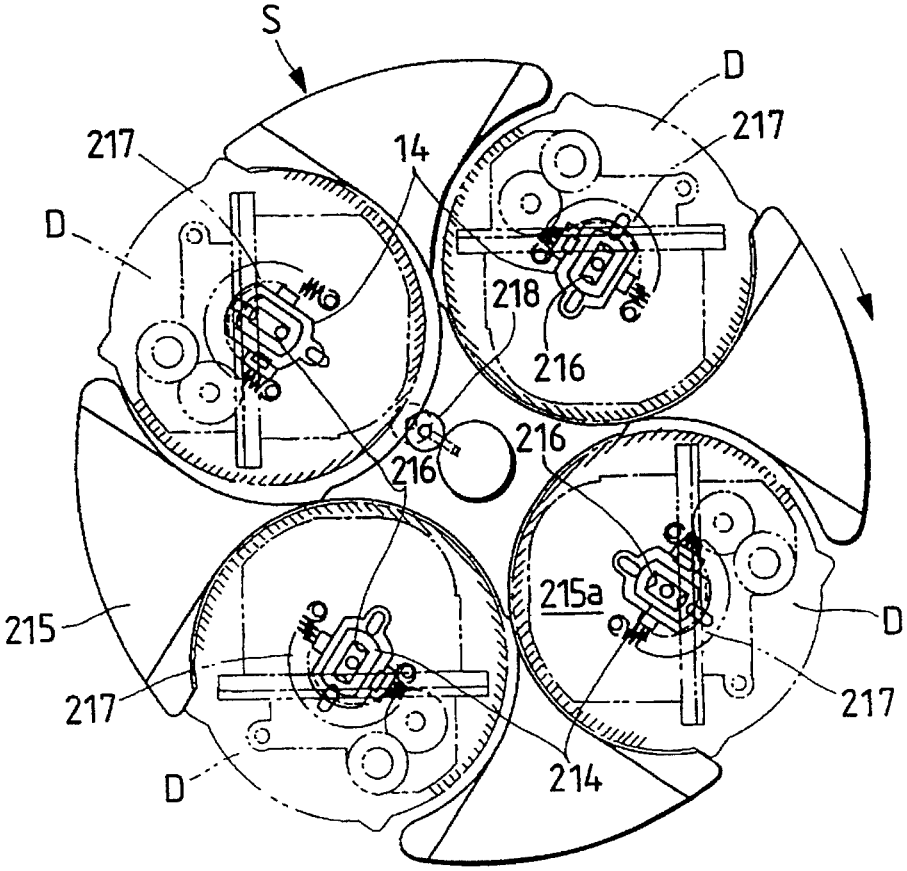
FIG. 37 is a front view of the switching mechanism on which the developing cartridge of FIG. 33 is mounted.

As shown in FIGS. 36 and 37, a developing cartridge switching mechanism S comprises a developing cartridge rotation supporting member 215 having a four-leaf clover cross-section including four semi-circular chambers, and developing device posture control members 214 each arranged at one end (front end in a developing cartridge inserting direction) of the corresponding chamber. Further, developing cartridge supporting portions 216 each comprising a hollow projection are arranged within the developing device posture control members 214. By fitting a boss 210*d* of the developing device 210 of the developing cartridge D into the hole of the supporting portion 216, the developing cartridge D is held on the supporting member 215 at a predetermined posture (orientation).

At the developing position opposed to the image bearing member 1, in order to shift the developing cartridge D toward the image bearing member 1 to position it with respect to the image bearing member for permitting the development, each posture control member 214 is arranged on the end face of the rotation supporting member 215 for shifting movement in the same direction as mentioned above. A spring 217 is wound around each posture control member 214 so that, after the development, the posture control member 214 at the developing position is returned to its original position away from the image bearing member 1 by the spring 217. On the other hand, a pressure member 218 for urging the developing cartridge D toward the image bearing member 1 at the developing position is non-rotatably secured to a rotary shaft 215*a* of the developing cartridge supporting member 215.

Figure 38:
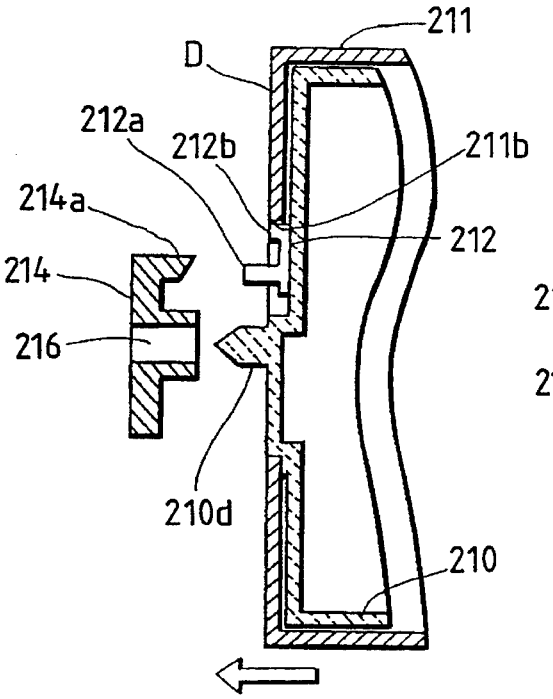
FIG. 38 is a side view showing a condition that the developing cartridge of FIG. 33 is being mounted on the rotary member of the developing cartridge switching mechanism.
Figure 39:
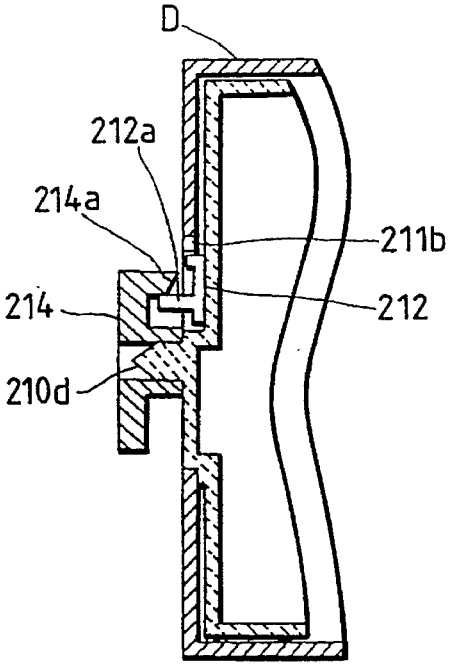
FIG. 39 is a side view showing a condition that a lock member of the developing cartridge is unlocked by the mounting of FIG. 38.

As shown in FIGS. 36 and 38, when the developing cartridge D is shifted along an axial direction of the developing sleeve 210*b* to be inserted along the rotary shaft of the rotation supporting member 215 at a mounting and dismounting position different from the developing position, as shown in FIG. 39, the fitting boss 210*d* formed on the front (in the inserting direction) end of the developing device 210 is fitted in the developing cartridge supporting portion 216, and then a lock release projection 214*a* of the posture control member 214 urges an arm portion 212*a* of the lock member 212 in opposition to an elastic force of the spring 213 to displace the lock member 212 radially inwardly to thereby disengage it from the notch 211*b*, thus releasing the locking condition between the developing device 210 and the support container 211 due to the pawl 212*b* of the lock member 212. Accordingly, thereafter, when the operator rotates the support container 211 with respect to the developing device 210 in a direction X in FIG. 34 via a grip 211*e* (FIG. 36) of the support container 211 to align the opening portion 211*a* of the support container 211 with the developing sleeve 210*b* of the developing device 210, the developing sleeve 210*b* is exposed to the outside. Thus, by rotating the supporting member 215, the developing sleeve 210*b* can be brought to a position where the sleeve is opposed to the image bearing member 1. Incidentally, in this embodiment, the developing sleeve 210*b* of each developing cartridge D is always directed radially outwardly.

According to this embodiment, in order to align the insertion angles (peripheral positions) of the developing cartridges D to be inserted into the supporting member 215, as shown in FIG. 36, two or more guiding projections 211*c*, fitting holes 200*b* and fitting holes 215*a* may be provided on the support container 211 of the developing cartridge D, an insertion opening 200*a* of a side plate 200 of the image forming apparatus and the developing cartridge supporting member 215, respectively, along their peripheries at two or more points, thereby preventing the wrong insertion of the developing cartridge D.

Further, in the condition that the developing sleeve 210*b* is exposed by rotating the support container 211 after the developing cartridges D are mounted to the image forming apparatus, since the positions of the projections 211*c* of the support container 211 are offset from the positions corresponding to the fitting holes 200*b*, even if the developing cartridge D tries to be dismounted from the rotation supporting member 215 in this condition, the cartridge cannot be removed from the supporting member because of the mechanical interference between the projections 211*c* and the inner surface of the side plage 200. That is to say, so long as the support container 211 is rotated in a direction opposite to the direction X to cover the developing sleeve 210*b* by the peripheral surface of the support container 211, the developing cartridge D cannot be removed from the supporting member 215.

When the toner in the toner containing portion 19 of the developing device 210 is used up, the exchange of the developing cartridge D can be effected by performing the above operations reversely.

That is to say, at the developing cartridge mounting and dismounting position, the support container 211 is rotated in a reverse direction to cover the developing sleeve 210*b* by the peripheral surface of the support container 211. Then, the developing cartridge D is drawn in a direction opposite to the inserting direction. In this case, before the boss 210*d* leaves the developing cartridge supporting portion (fitting hole) 216 of the posture control member 214, the arm portion 212*a* of the lock member 212 is disengaged from the lock releasing projection 214*a*. As a result, during the developing cartridge D is still maintained in the predetermined posture, the lock member 212 is fitted into the notch 211*b* of the support container 211 by the biasing force of the spring 213, thereby interlocking the developing device 210 and the support container 211. Thereafter, the boss 210*d* leaves the fitting hole 216 of the posture control member 214, and then the developing cartridge D is retracted from the image forming apparatus.

Figure 40:
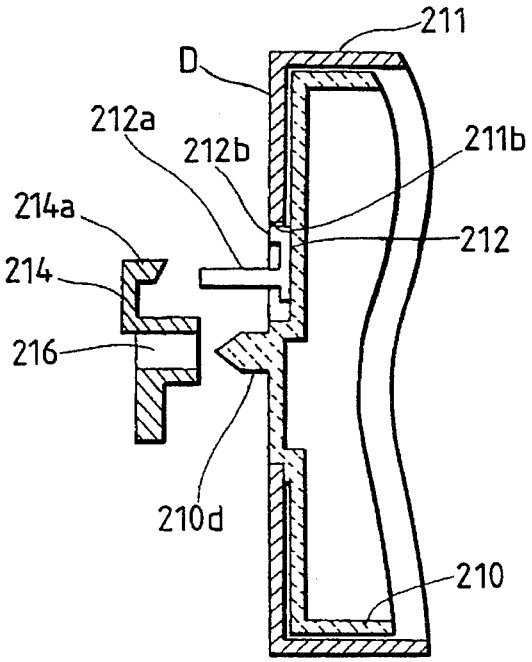
FIG. 40 is a side view showing another example of a posture control mechanism.

Now, in this embodiment, while a height relation between the fitting boss 210*d* of the developing device 210 and the arm portion 212*a* of the lock member 212 was selected that the boss 210*d* is higher than the arm portion, when the positioning of the developing device 210 is effected prior to the unlocking, as shown in FIG. 40, the arm portion 212*a* may be higher than the fitting boss.

In this embodiment, since the developing cartridge D and the switching mechanism for the developing cartridges are constructed as mentioned above, when the developing cartridge D is dismounted from the image forming apparatus or when a new developing cartridge D is mounted to the image forming apparatus, since the developing sleeve 210*b* of the developing device 210 is always covered by the support container 210 and since the developing sleeve 210*b* is exposed only when the developing cartridge D is held by the rotation supporting member 215 in the predetermined posture, it is possible to prevent the toner contamination and the damage of the developing sleeve 210*b*. Further, since the locking condition of the developing device 210 with respect to the support container 211 can be released only by inserting developing cartridge D into the image forming apparatus, the operability for mounting the developing cartridge D can be improved.

Figure 41:
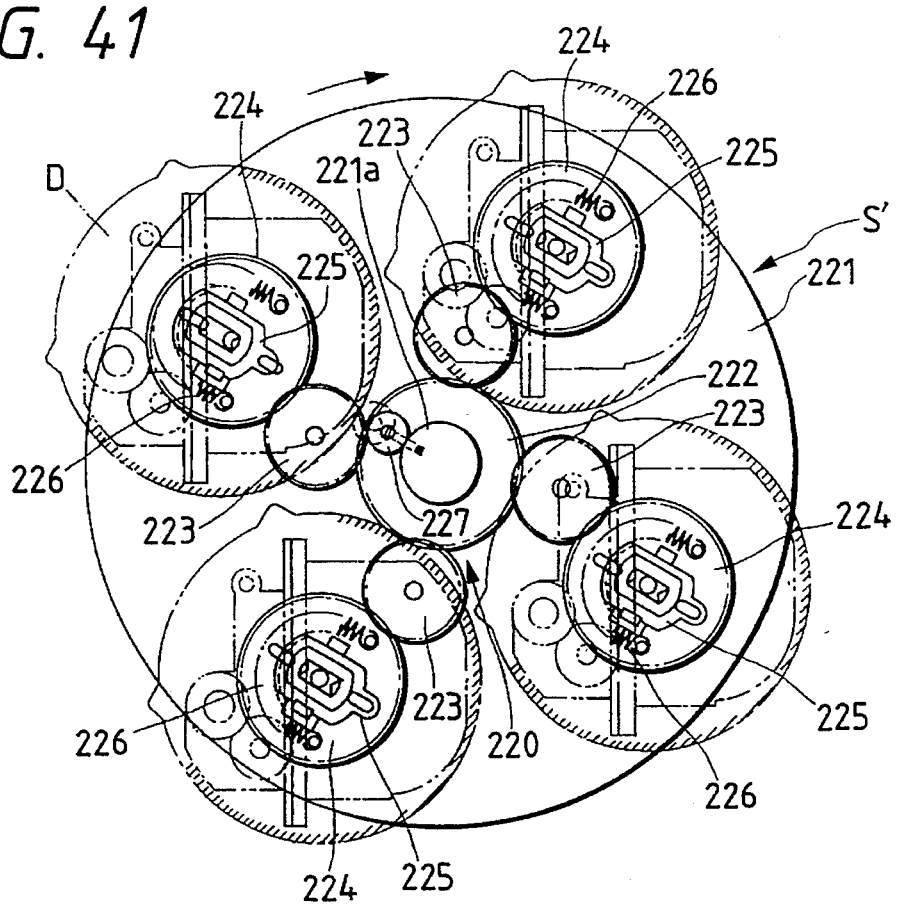
FIG. 41 is a front view of a developing cartridge switching mechanism in an image forming apparatus according to an eleventh embodiment of the present invention.

FIG. 41 is a front view of a developing cartridge switching mechanism according to an eleventh embodiment of the present invention.

In this embodiment, a developing cartridge switching mechanism S'comprises a posture control portion 220, and a rotation supporting member 221. The posture control portion 220 comprises a central sun gear 222 secured to a rotary shaft 221*a* of the rotation supporting member 221, posture control gears 224 provided at mounting positions of developing cartridges, and idler gears 223 disposed between the sun gear 222 and the posture control gears 224 and meshed with these gears. Further, at the developing position opposed to the image bearing member 1, in order to shift the developing cartridge D toward the image bearing member 1 for permitting the development, developing cartridge supporting members 225 (similar to the posture control members 214 shown in FIGS. 36 and 37) are supported on the respective posture control gears 224 for shifting movement in the same direction as mentioned above, and, a return spring 226 for applying a biasing force in the same direction as mentioned above is arranged on the corresponding developing cartridge supporting member 225 to return the developing cartridge D to its original position away from the image bearing member 1 after the development.

On the other hand, a pressure member 227 for urging the developing cartridge D toward the image bearing member 1 is non-rotatably secured to the rotary shaft 221*a* of the rotation supporting member 221. The sun gear 222 and the posture control gears 224 have the same number of teeth. Since the sun gear 222 is secured to the rotary shaft 221*a*, when the posture control portion 220 and the rotation supporting member 221 are integrally rotated the posture control gears 224 are shifted around the rotary shaft 221*a* without changing the postures thereof. Thus, the supporting members 225 arranged on the gears 224 are always oriented in the constant direction.

Accordingly, when the developing cartridge D is inserted into the rotation supporting member 221 at the mounting and dismounting position, the locking condition between the developing device 210 of FIG. 33 and the support container 211 is released. Further, in this mounting condition, since the developing cartridge D is positioned so that the developing device 210 is opposed to the image bearing member 1 and the opening portion 211*a* of the support container 211 is aligned with the developing portion 210*c* and since such posture does not change during the rotation of the switching mechanism S', the inserting operation of the developing cartridge D can be simplified, and a bad influence such as the concentration of toner in the proximity of the developing sleeve (developer bearing member) and the developing blade (toner thickness regulating member) can be eliminated. Further, at any position other than the developing position, since the opening portion 211*a* of the support container 211 is not aligned with the developing portion, the leakage of toner can be prevented.

Lastly, a twelfth embodiment of the present invention will be explained with reference to FIG. 42.

Figure 42:
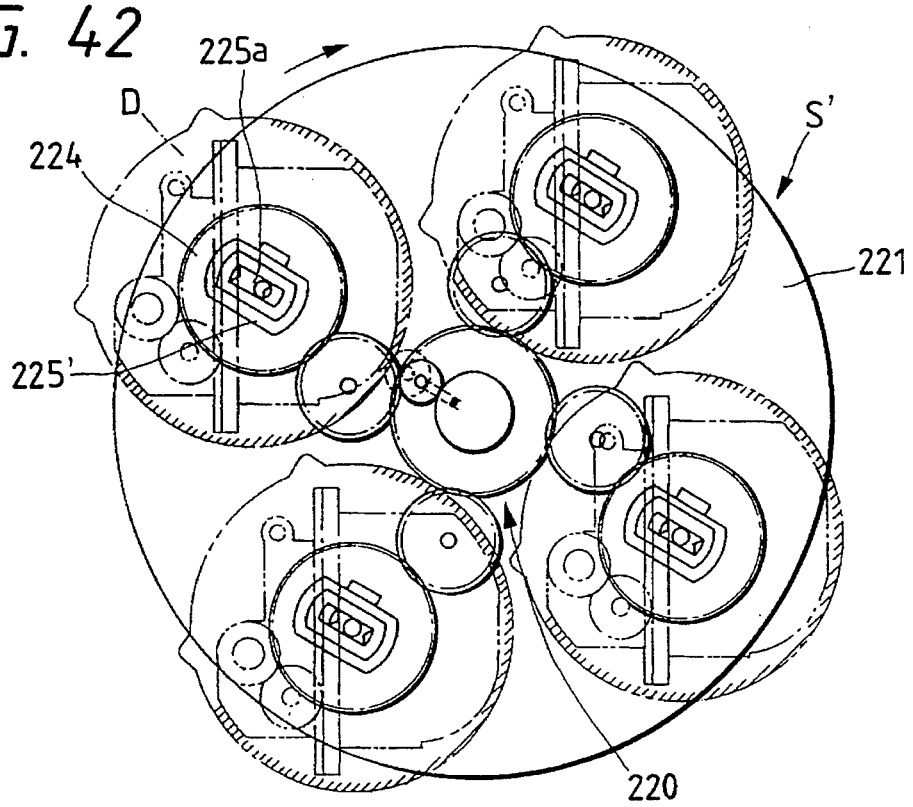
FIG. 42 is a front view of a developing cartridge switching mechanism in an image forming apparatus according to a twelfth embodiment of the present invention.

In this embodiment, in place of the posture control gears 224 of the posture control portion 220 in the above eleventh embodiment explained in connection with FIG. 41, as shown in FIG. 42, posture control gears 224'on which developing cartridge supporting members 225'are directly formed are used, and a slot 225*a* having the same length as the shifting amount of the developing cartridge D at the developing position is formed in each developing cartridge supporting members 225'.

Since the slot 225*a* is inclined upwardly with respect to the urging direction of the developing cartridge D, after the development, the developing cartridge D is returned to its original position by its own weight at the developing position. Thus, according to this embodiment, the return springs can be omitted.

While the present invention has been explained in connection with specific embodiments, it should be noted that the present invention is not limited to such embodiments, and various alterations and modifications can be made within the scope of the present invention.

What is claimed is:

1. A developing cartridge comprising:

a developing device having a containing portion containing developer, and a bearing member for bearing the developer;

a support member adapted to rotatably support said developing device and having an opening portion; and lock means for locking a rotation of said developing device with respect to said support member at a position where said bearing member is not aligned with said opening portion.

2. A developing cartridge according to claim 1, wherein said support member has a substantially cylindrical shape.

3. A developing cartridge according to claim 1, further comprising a shaft portion of said developing device for permitting the relative rotation of said developing device with respect to said support member.

4. A developing cartridge according to claim 1, further comprising a release portion for releasing a locking condition of said lock means.

5. A developing apparatus comprising:

a rotatable developing unit;

a developing cartridge detachably supported by said developing unit, said developing cartridge including a developing device having a containing portion for containing developer, a bearing member for bearing the developer thereon, and a support member, having an opening portion, for rotatably supporting said developing device and being non-rotatably supported by said developing unit; and rotation means for rotating said developing device relative to said support member during a rotation of said developing unit.

6. A developing apparatus according to claim 5, wherein said rotation means rotates said developing device with respect to said support member in such a manner that a posture of said developing device is unchanged.

7. A developing apparatus according to claim 5, wherein said developing unit is rotated to position the bearing member of a selected developing device at a predetermined developing position, and said opening portion is aligned with said bearing member at said developing position.

8. A developing apparatus according to claim 5, wherein said rotation means has a non-rotatable first gear disposed on a rotational center of said developing unit, a second gear disposed on a rotary shaft of said developing device, and an intermediate gear meshed with said first and second gears.

9. A developing apparatus according to claim 5, wherein said developing unit removably supports a plurality of developing cartridges.

* * * * *

UNITED STATES PATENT AND TRADEMARK OFFICE

CERTIFICATE OF CORRECTION

PATENT NO. : 5,497,220

DATED : March 5, 1996

INVENTOR(S) : Mitsugu INOMATA, et al.

It is certified that error appears in the above-indentified patent and that said Letters Patent is hereby corrected as shown below:

ON THE TITLE PAGE:

ITEM [57] - ABSTRACT:

"there" should read --where--.

COLUMN 6:

Line 8, "dishshaped" should read --dish-shaped--.

COLUMN 8:

Line 67, "or" should be deleted.

COLUMN 9:

Line 5, "nor"should read --not--.

COLUMN 14:

Line 28, "during" should read --while--; and
Line 39, "that" should read --so that--.

UNITED STATES PATENT AND TRADEMARK OFFICE

CERTIFICATE OF CORRECTION

PATENT NO. : 5,497,220

DATED : March 5, 1996

INVENTOR(S) : Mitsugu INOMATA, et al.

It is certified that error appears in the above-indentified patent and that said Letters Patent is hereby corrected as shown below:

COLUMN 14:

Line 28, "during" should read --while--; and
Line 39, "that" should read --so that--.

Signed and Sealed this

Ninth Day of July, 1996

Bruce Lehman

*Attest:*

BRUCE LEHMAN

*Attesting Officer*

*Commissioner of Patents and Trademarks*